US007290951B2

(12) United States Patent
Tanaka et al.

(10) Patent No.: US 7,290,951 B2
(45) Date of Patent: Nov. 6, 2007

(54) BRAILLE LAYOUT CREATION METHOD, BRAILLE LAYOUT CREATION SYSTEM, PROGRAM, AND RECORDING MEDIUM

(75) Inventors: Seiji Tanaka, Azumino (JP); Makoto Takada, Shiojiri (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 11/359,048

(22) Filed: Feb. 22, 2006

(65) Prior Publication Data

US 2006/0198679 A1 Sep. 7, 2006

(30) Foreign Application Priority Data

Mar. 3, 2005 (JP) ..... 2005-059484

(51) Int. Cl.
*B41J 3/32* (2006.01)

(52) U.S. Cl. ..... 400/109.1; 400/483

(58) Field of Classification Search ..... 400/109.1, 400/483

See application file for complete search history.

(56) References Cited

FOREIGN PATENT DOCUMENTS

| | | |
|---|---|---|
| JP | 2003-182158 | 7/2003 |
| KR | 2002-0053988 | 7/2002 |

*Primary Examiner*—Minh Chau
(74) *Attorney, Agent, or Firm*—Hogan & Hartson LLP

(57) ABSTRACT

A braille layout creation method includes the steps of sequentially reading information for braille embossing from a list file in which a plurality of pieces of information for braille embossing is listed, converting the read information into a braille pattern, and importing, for each reading of the information, the braille pattern into an object frame disposed in an image of a braille sheet on which a braille character is embossed.

7 Claims, 20 Drawing Sheets

(Note: Ink-characters are transliteration of Japanese hiragana; braille characters are those of hiragana, not of alphabets. Same applies to other similar Figs. 8A, 9A to 9C, 13B, 15A, and 15B)

FOR MAKING INK CHARACTER LABEL

FOR MAKING BRAILLE LABEL

| 10500yen(zeikomi) | | | |
|---|---|---|---|
| | A | B | C |
| 1 | 1050 | 1050yen(zeiko) | 1050_yen |
| 2 | 1575 | 1575yen(zeiko) | 1575_yen |
| 3 | 2100 | 2100yen(zeiko) | 2100_yen |
| 4 | 5250 | 5250yen(zeiko) | 5250_yen |
| 5* | 10500 | 10500yen(zeik | 1man 500_yen(zeikomi) |
| 6 | | | |

MB1

MB2

MB3 a:LENGTH OF BRAILLE OBJECT IN TAPE WIDTH DIRECTION
b:LENGTH OF BRAILLE OBJECT IN TAPE LENGTH DIRECTION
d1:TAIL MARGIN FOR EMBOSSING FOR UPPER BRAILLE CHARACTER
d2:TAIL MARGIN FOR EMBOSSING FOR LOWER BRAILLE CHARACTER
L:BOUNDARY LINE FOR ADSORPTION SWITCHING

BRAILLE LAYOUT CREATION METHOD, BRAILLE LAYOUT CREATION SYSTEM, PROGRAM, AND RECORDING MEDIUM

The entire disclosure of Japanese Patent Application No. 2005-059484, filed Mar. 3, 2005, is expressly incorporated by reference herein.

BACKGROUND

1. Technical Field

The present invention relates to a braille layout creation method, a braille layout creation system, a program, and a recording medium for creating a braille layout by disposing a braille object in an image of a braille sheet on which a braille character is embossed.

2. Related Art

A braille embosser that embosses braille characters, which are readable and comprehensible by visually impaired people by touching with their fingers, on a braille sheet is known (for example, see Japanese Unexamined Patent Application Publication No. 2003-182158).

When a braille embosser of this type is used by being connected to an external apparatus, such as a personal computer, including a display screen and an input device, normally, a braille layout is created such that the external apparatus creates an object (braille object) of a braille pattern representing embossing or non-embossing of each embossing point of a braille character and disposes the object in an image of a braille sheet.

In known apparatuses, a braille layout is created by performing a series of processing of inputting braille transcription information for performing braille embossing, converting the braille transcription information into a braille pattern to create a braille object, and disposing the braille object in an image of a braille sheet. Thus, even when many braille products, such as braille labels, are required to be made, some pieces of braille transcription information cannot be input together or some braille patterns cannot be created together. Therefore, the series of processing must be repeated the number of times corresponding to the number of braille products to be made, and this requires greater efforts.

SUMMARY

An advantage of the invention is that it provides a braille layout creation method, a braille layout creation system, a program, and a recording medium capable of creating many braille products quickly and easily.

A braille layout creation method according to an aspect of the invention includes the steps of sequentially reading information for braille embossing from a list file in which a plurality of pieces of information for braille embossing is listed, converting the read information into a braille pattern, and importing, for each reading of the information, the braille pattern into an object frame disposed in an image of a braille sheet on which a braille character is embossed.

In addition, a braille layout creation system according to an aspect of the invention includes a layout display device that displays an image of a braille sheet on which a braille character is embossed and an object frame disposed in the image of the braille sheet, a list display device that displays a list in which a plurality of pieces of information for braille embossing is listed, an information reading device that sequentially reads the information from the list, a conversion device that converts the read information into a braille pattern, and an import device that imports, for each reading of the information performed by the information reading device, the converted braille pattern into the object frame.

With this configuration, information is sequentially read from a list file (list), the read information is converted into a braille pattern, and the braille pattern is imported into an object frame disposed in an image of a braille sheet. Thus, by inputting a plurality of pieces of information in a list file, many braille products can be made quickly and easily. In other words, by sequentially incrementing information listed in the list file and by importing the information into the object frame, that is, by performing loading, a braille product obtained by sequentially changing a braille pattern can be easily made. The braille pattern indicates information representing embossing or non-embossing of each of a plurality of embossing points constituting a braille character.

Preferably, the braille layout creation method further includes the step of performing braille embossing in accordance with the braille pattern imported into the object frame. In addition, preferably, in the step of sequentially reading the information, the information is sequentially read from the list file for each braille embossing performed by the step of performing the braille embossing.

With this configuration, since information is sequentially read from the list file for each braille embossing, a user does not need to perform an operation as a trigger for reading information. In other words, many braille products with different contents can be made by only giving an embossing instruction.

Preferably, in the braille layout creation method, the information is original text information input as text data. In addition, preferably, in the step of converting the read information, the original text information read from the list file is converted into braille transcription information in accordance with a braille notation, and the braille transcription information is converted into the braille pattern.

With this configuration, if original text information as text data is input to the list file, the original text information is converted into braille transcription information (a braille document) in accordance with a braille notation (based on a braille conversion rule), and the braille transcription information is converted into a braille pattern. Thus, even a user who does not have knowledge of braille transcription is able to create a braille pattern easily. In addition, since a user who has knowledge of braille transcription is only required to input original text information, instead of braille transcription information, to a list file, efforts in braille transcription can be eliminated.

Preferably, the braille layout creation method further includes the step of editing the converted braille transcription information. In addition, preferably, in the step of converting the read information, the edited braille transcription information is converted into the braille pattern.

With this configuration, if conversion from original text information into braille transcription information is not performed correctly, correction can be performed. Thus, embossing of an incorrect braille pattern can be avoided.

Preferably, the braille layout creation method further includes the step of disposing the object frame in a position.

With this configuration, an object frame into which a braille pattern is imported can be disposed in a position desired by the user. In addition, even in a case where a not-embossable area in which a braille character cannot be embossed occurs in a braille sheet due to a position of an embossing unit that embossing a braille character or a position of a feed roller that feeds a braille sheet, an object frame can be disposed in an appropriate position other than the not-embossable area.

Preferably, the braille layout creation system further includes a disposing device that disposes the object frame in the image of the braille sheet by dragging and dropping the information within the list.

With this configuration, an object frame can be disposed while the user manually checks the position of the object frame.

A program according to an aspect of the invention causes a computer to function as each device in the above-described braille layout creation system.

A recording medium according to an aspect of the invention is computer-readable and records the above-described program.

By executing the program, many braille products can be made quickly and easily.

BRIEF DESCRIPTION OF THE DRAWINGS

The invention will be described with reference to the accompanying drawings, wherein like numbers reference like elements.

DESCRIPTION OF EXEMPLARY EMBODIMENTS

A braille layout creation method, a braille layout creation system, a program, and a recording medium according to an embodiment of the invention will be described with reference to the drawings. According to an embodiment of the invention, a braille layout is created by displaying an image of a braille sheet on which a braille character is embossed on a screen and by disposing a braille object in the image of the braille sheet, and a braille pattern is imported from a list into the braille object. A case where a braille layout creation system according to an embodiment of the invention is applied to a label-making system for making a braille label in which braille characters that can be comprehended by visually impaired people and ink characters that can be seen by sighted people who are not visually impaired are disposed on the same tape will be described.

Figure 1:
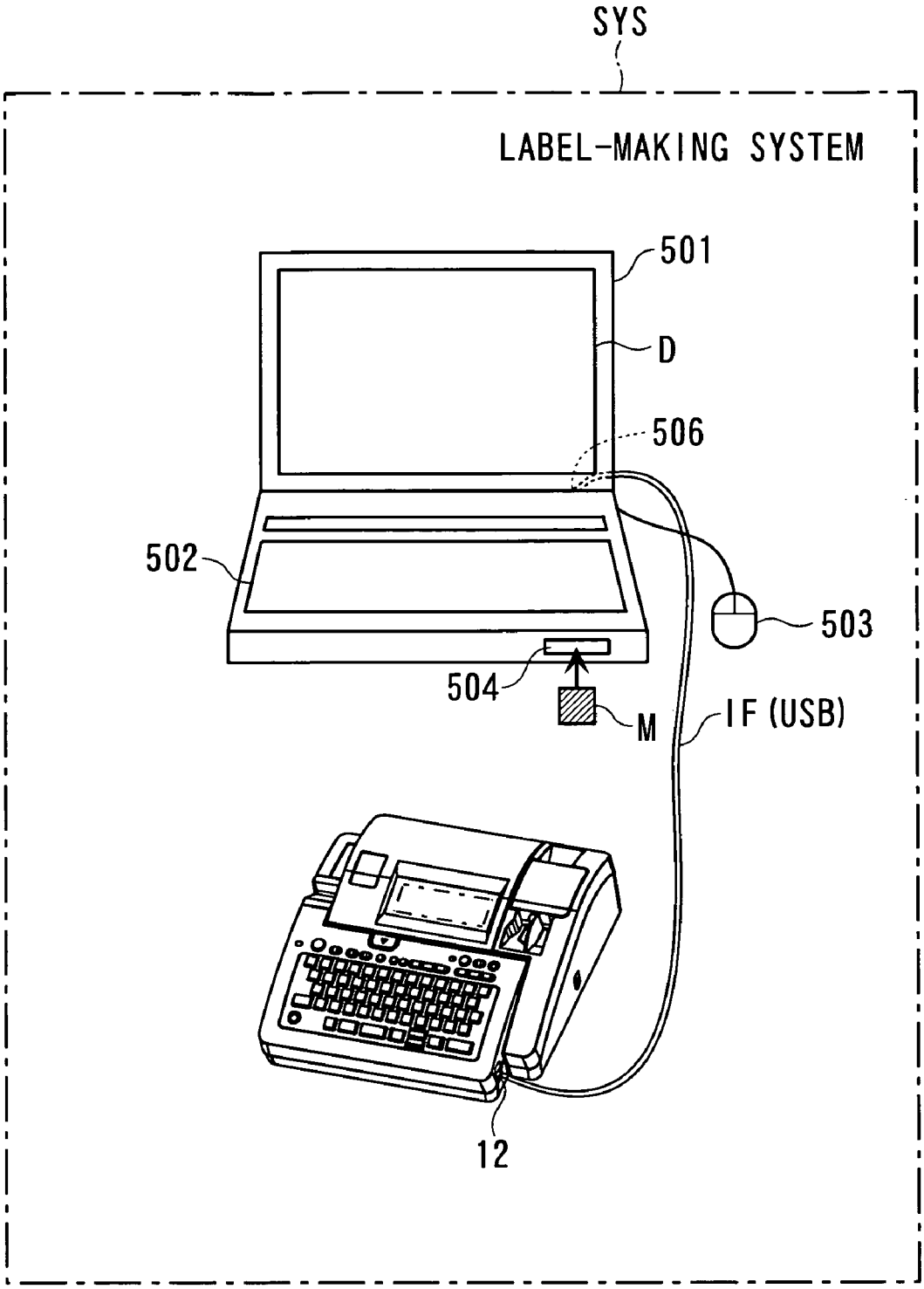
FIG. 1 shows the system configuration of a label-making system according to embodiments of the invention.

FIG. 1 shows the system configuration of a label-making system SYS. Referring to FIG. 1, the label-making system SYS includes a label-making apparatus 1 and a personal computer (PC) 501. The label-making apparatus 1 prints ink characters and embosses braille characters on a tape T. The PC 501 generates ink character data for ink character printing and braille data for braille embossing, and transfers the generated data to the label-making apparatus 1.

The PC 501 includes an input device including a keyboard 502 and a mouse 503, a display D, a memory card slot 504 for reading various recording media M including a PC card and a memory card, and a universal serial bus (USB) connector 506 connected to the label-making apparatus 1 via an interface IF (a USB cable). In addition, in the label-making system SYS, support software (an application) for creating an ink character layout and a braille layout and a driver for controlling the label-making apparatus 1 are installed in the PC 501 in advance.

The label-making apparatus 1 is also capable of performing printing processing and embossing processing in a single unit state in which the label-making apparatus 1 is not connected to the PC 501. However, a case where the PC 501 mainly controls the label-making apparatus 1 will be described.

Figure 2:
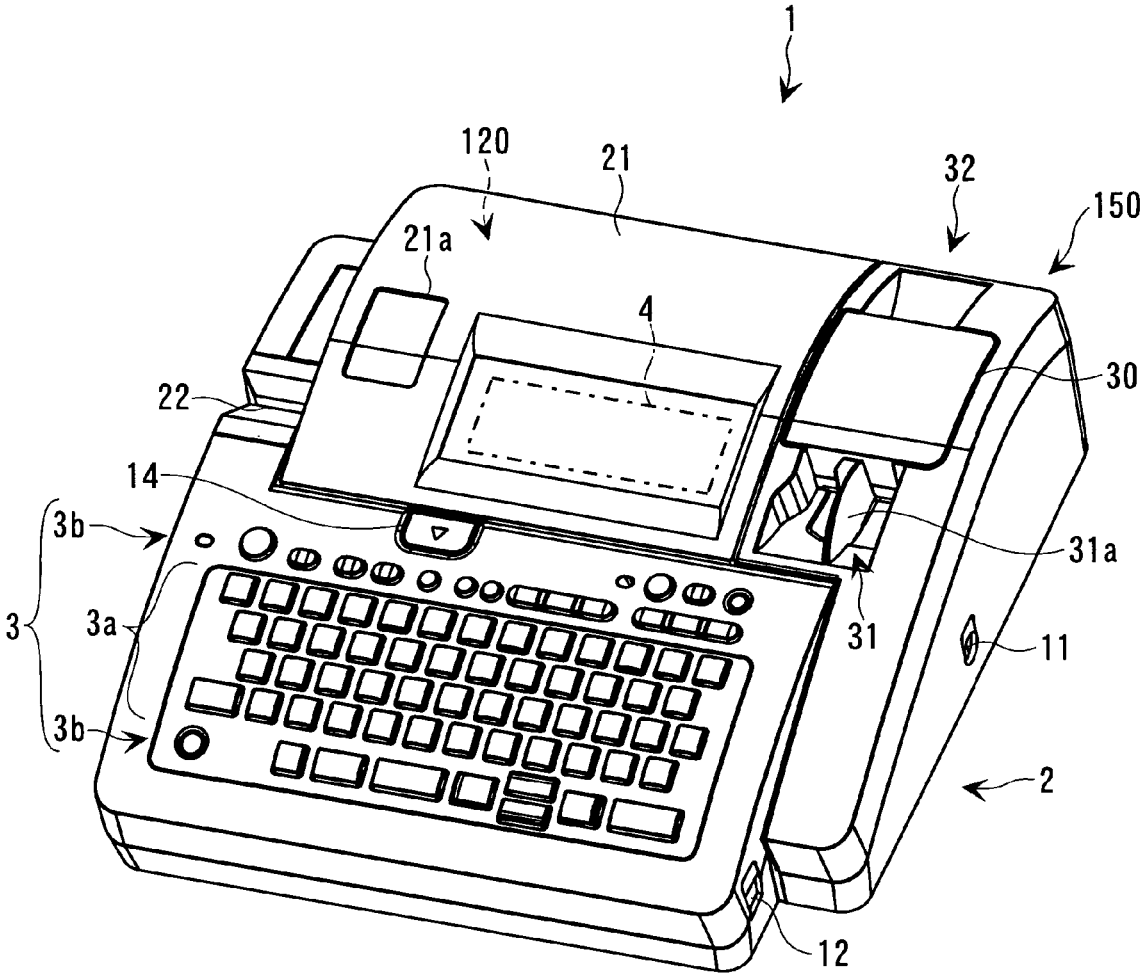
FIG. 2 is an external perspective view of a label-making apparatus with its lid closed.
Figure 3:
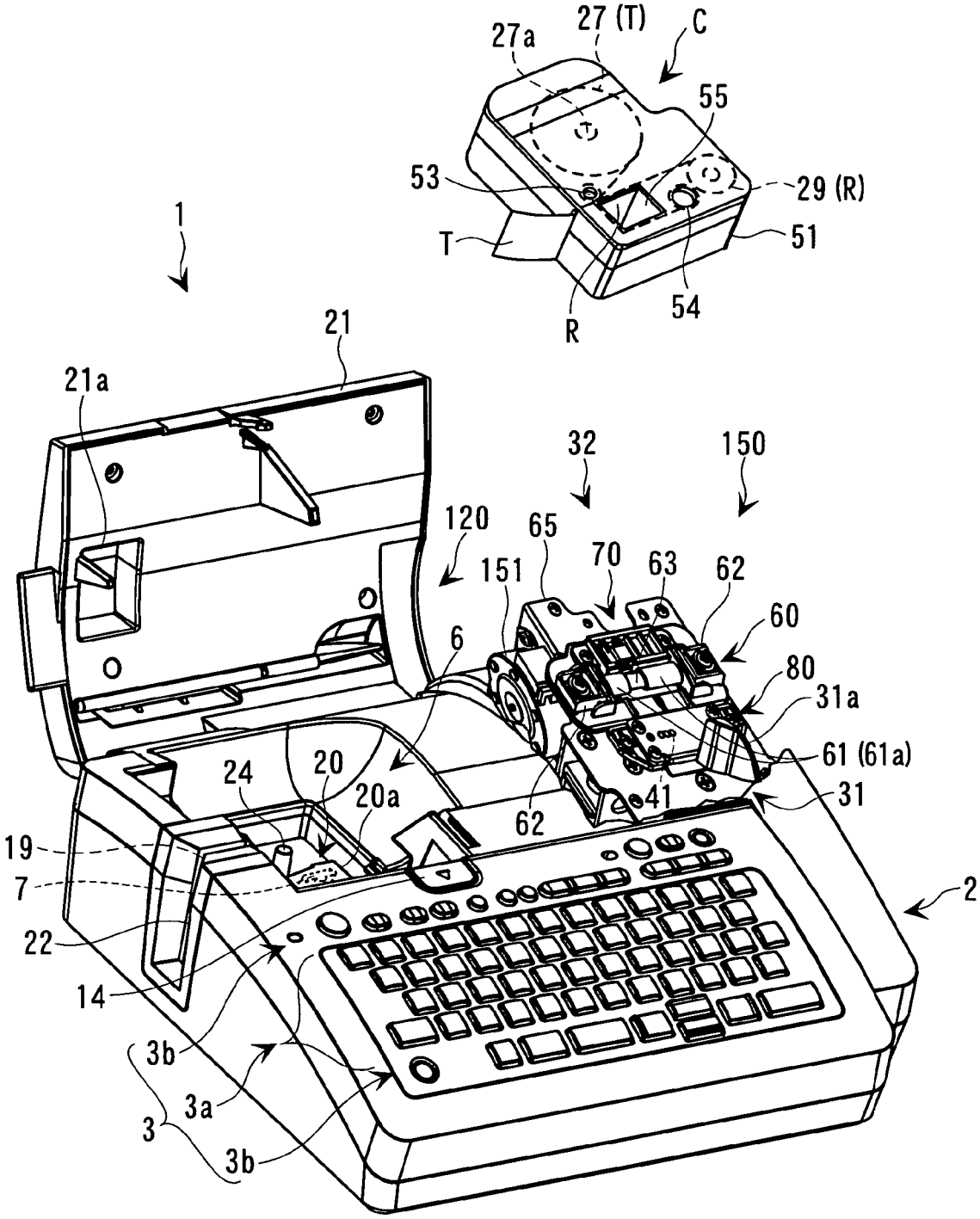
FIG. 3 is an external perspective view of the label-making apparatus with the lid opened.

FIG. 2 is an external perspective view of the label-making apparatus 1 with its lid closed, and FIG. 3 is an external perspective view of the label-making apparatus 1 with its lid opened. In FIG. 3, for easier understanding of a braille-embossing section 150 that performs braille embossing, the label-making apparatus 1 is illustrated such that part of an apparatus case 2 functioning as an outer shell of the label-making apparatus 1 is cut out. As shown in FIGS. 2 and 3, a keyboard 3 is arranged on the upper front surface of the apparatus case 2, and an opening/closing lid 21 is mounted on the upper rear surface of the apparatus case 2. An ink character printing section 120 that performs ink character printing (printing of characters, such as letters and marks) on the tape T fed from a tape cartridge C is provided inside the opening/closing lid 21. The braille-embossing section 150 that performs braille embossing on the tape T manually inserted from a front portion is provided at the right of the opening/closing lid 21 (in the right rear portion of the apparatus case 2).

A display 4 having a rectangular shape is formed on the front side of the opening/closing lid 21. A cartridge-mounting section 6 (the ink character printing section 120) for mounting the tape cartridge C is provided in a recess in a left portion inside the opening/closing lid 21. The tape cartridge C is detachably mounted in the cartridge-mounting section 6 when the opening/closing lid 21 is opened by depression of a lid-opening button 14. In addition, the opening/closing lid 21 has a view port 21*a* through which a user is able to observe whether the tape cartridge C is mounted or not without opening the opening/closing lid 21.

The display 4 is capable of displaying display image data of 192×80 dots inside a rectangular shape of about 12 cm in the horizontal direction (X direction)×about 5 cm in the vertical direction (Y direction). The display 4 is used for displaying character information and six-dot braille information input by the user using the keyboard 3 and for generating and editing ink character data for ink character printing and braille data for braille embossing in accordance with the input information. When the label-making apparatus 1 connected to the PC 501 is used, the PC 501 inputs character information and generates data. Thus, the display 4 is used supplementarily for indicating the width of an accommodated tape, an error message, and the like.

The keyboard 3 including various input keys is arranged on the upper surface of the apparatus case 2. The keyboard 3 includes a character key group 3*a* and a function key group 3*b* for designating various operation modes and the like. The character key group 3*a* is used for inputting character information and six-dot braille information and has a full-key configuration based on the Japanese Industrial Standards (JIS) keyboard layout. The function key group 3*b* includes a "feed start" key for indicating feed start of the tape T in the braille-embossing section 150, an "embossing start" key for starting braille embossing manually, and a PC link key for selecting between a PC communication mode in which processing is performed in accordance with printing data and embossing data received from the PC 501 and a single unit mode in which processing is perform in accordance with data input via the keyboard 3. When the PC link key is depressed, the PC communication mode is entered. In the PC communication mode, information input via the character key group 3*a* of the label-making apparatus 1 becomes invalid.

A power supply opening 11 for power supply is provided at the center of the right side of the apparatus case 2. A USB connecter 12 for establishing connection with the PC 501 is provided at the front of the right side of the apparatus case 2. In addition, a printed tape output slot 22 via which the cartridge-mounting section 6 communicates with the outside is provided on the left side of the apparatus case 2. A cutting mechanism 19 (a cutting section 140, see FIG. 7) for cutting the tape T fed from the ink character printing section 120 is provided so as to face the printed tape output slot 22. The tape T is cut by the cutting mechanism 19 so that the tape T is output through the printed tape output slot 22 after ink character printing is performed.

The structure of component parts around the ink character printing section 120 (the cartridge-mounting section 6) and the braille-embossing section 150 is described next. The cartridge-mounting section 6 includes a head unit 20 including a print head 7, which is a thermal head, housed in a head cover 20*a*, a platen-driving shaft (not shown) facing the print head 7, a take-up drive shaft (not shown) for taking up an ink ribbon R, which will be described below, and a positioning boss 24 for a tape reel 27, which will be described below. In addition, a print feed motor 121 (see FIG. 7) for rotating the platen-driving shaft and the take-up drive shaft is provided in a lower portion inside the cartridge-mounting section 6.

The tape reel 27 onto which the tape T having a constant width is wound and a ribbon reel 29 onto which the ink ribbon R is wound are provided inside a cartridge case 51 of the tape cartridge C. The tape reel 27 is provided in the upper center portion inside the cartridge case 51, and the ribbon reel 29 is provided in the lower right portion inside the cartridge case 51. The width of the tape T and the width of the ink ribbon R are equal to each other. A through hole 55 for receiving the head cover 20*a* that covers the head unit 20 is provided at the lower left of the tape reel 27. A platen roller 53 that engages with the platen-driving shaft to be driven to rotate is disposed in a position corresponding to a portion in which the tape T overlaps the ink ribbon R. A ribbon take-up reel 54 is disposed near the ribbon reel 29. The ink ribbon R unreeled from the ribbon reel 29 is taken up onto the ribbon take-up reel 54 disposed so as to go around the head cover 20*a*.

When the tape cartridge C is mounted in the cartridge-mounting section 6, the head cover 20*a* is received in the through hole 55, the positioning boss 24 is received in a central hole 27*a* of the tape reel 27, and the take-up drive shaft is received in a central hole of the ribbon take-up reel 54. The print head 7 comes into contact with the platen-driving shaft (platen roller) so as to sandwich the tape T and the ink ribbon R therebetween, and ink character printing can be performed. The tape T is fed to the printed tape output slot 22 after ink character printing is performed.

Although not particularly illustrated, the tape T includes a recording sheet and a peel sheet. The recording sheet is made of resin, such as polyethylene terephthalate, and the rear surface of the recording sheet is provided with an adhesive layer. The peel sheet is made of resin, such as a polyethylene/polypropylene copolymer, adhered to the recording sheet with the adhesive layer therebetween. The print face of the recording sheet is processed such that ink can be transferred well onto the recording sheet. "Half cutting", which will be described below, is processing of cutting only the recording sheet, out of the laminated recording sheet and peel sheet, in the tape width direction so that the peel sheet can be easily peeled off.

In addition, various types of tapes with different widths, colors, ink colors for ink characters, materials, and the like are prepared to be used as the tape T. A plurality of holes (not shown) used for indicating the type of the tape T is provided in the rear surface of the cartridge case 51. In addition, a plurality of tape identification sensors (micro switches) 171 (see FIG. 7) detecting the type of the tape T is provided in the cartridge-mounting section 6 so as to correspond to the respective holes. The type of the tape T can be determined by detecting states of the tape identification sensors 171.

An embossing assembly (the braille-embossing section 150) that performs braille embossing is built in the rear right portion inside the apparatus case 2. An embossing section cover 30 is provided on the upper surface of the apparatus case 2 so as to cover the embossing assembly. In addition, an embossing tape insertion slot 31 into which the user manually inserts (installs) the tape T is provided as a recess in front of the embossing section cover 30, and an embossing tape output slot 32 from which the tape T after braille embossing is performed is output is provided as a recess behind the embossing section cover 30. The embossing tape insertion slot 31 and the embossing tape output slot 32 are inclined to form a downward slope along a tape-conveying path (feed path) 70. In addition, a manual feed guide 31*a* that is capable of adjusting the width in the tape width direction is provided near the embossing tape insertion slot 31.

The braille-embossing section 150 includes an embossing unit 80 that performs braille embossing using three embossing pins (embossing heads) 41 (see FIG. 5B), a tape feed unit 60 that feeds toward the embossing tape output slot 32 the tape T inserted into the embossing tape insertion slot 31, and the tape-conveying path 70 along which the tape T is conveyed. These units are incorporated into a frame forming the tape-conveying path 70 and form the embossing assembly. The embossing assembly is integrally mounted to the apparatus case 2. Braille characters B are formed by selectively driving the three embossing pins 41 by the embossing unit 80 with respect to the tape T fed by the tape feed unit 60 along the tape-conveying path 70.

The tape feed unit 60 includes a feed roller 61, a supporting member 62 that supports the feed roller 61 onto an apparatus frame 65, and an embossing feed motor 151 that can rotate forward and backward in order to rotate the feed roller 61. The feed roller 61 is a grip roller including a driving roller (not shown) and a driven roller 61*a*. An annular groove 63 (see FIG. 6) is arranged in the driven roller 61*a* in order to avoid interference of positions corresponding to vertical three embossing points 201 (see FIG. 4A) so as not to smash the formed braille characters B.

Figure 4A:
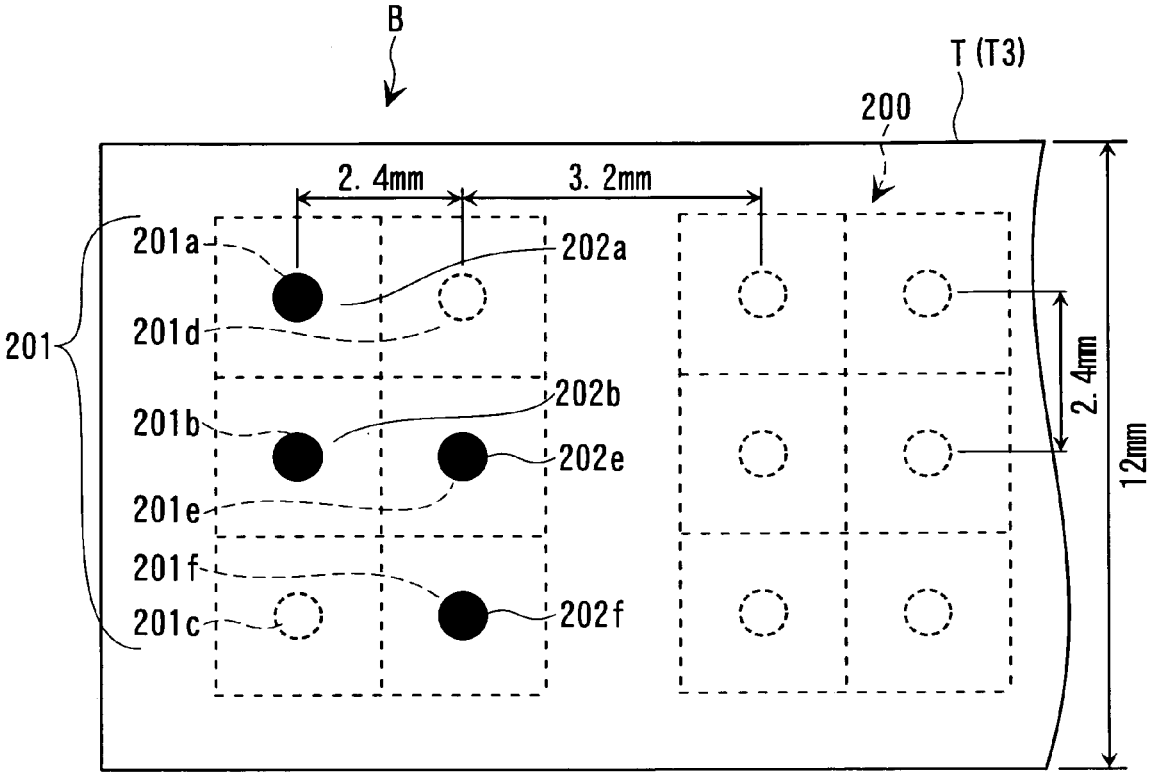
FIGS. 4A and 4B are an explanatory diagram of a six-dot braille character and cross-sectional views of embossing projections.

A braille character B (six-dot braille character B) formed on a tape T (in this example, a tape T3 with a tape width of 12 mm) will be described with reference to FIGS. 4A and 4B. FIG. 4A shows a braille character (braille data) B representing character information of a Japanese hiragana "si". As shown in FIG. 4A, a single six-dot braille character B is defined by a cell 200 including six dots (embossing points) constituted by two columns and three rows. The cell 200 represents a character or an attribute, such as a dakuten symbol (a Japanese voiced sound symbol). In other words, a braille string is formed by two or more embossing columns and three embossing rows. An eight-dot braille character, which is defined by a cell including eight dots constituted by two columns and four rows, representing a kanji character (a Japanese ideographic character) is also used as well as a six-dot braille character B representing a kana character, a number, or the like. Obviously, the invention is also applicable to a label-making apparatus that forms eight-dot braille characters.

Each six-dot braille character B is defined by the cell 200, which is divided into six embossing points 201*a* to 201*f* based on an arrangement pattern of two columns and three rows. In FIG. 4A, four embossing points 201*a*, 201*b*, 201*e*, and 201*f* are selected from among the six embossing points 201*a* to 201*f* and are embossed, and four embossed projections 202*a*, 202*b*, 202*e*, and 202*f* are formed on the tape T. Six embossed projections 202*a* to 202*f* are arranged with a vertical pitch of about 2.4 mm and a horizontal pitch of about 2.4 mm. A pitch between cells is about 3.2 mm.

Figure 4B:
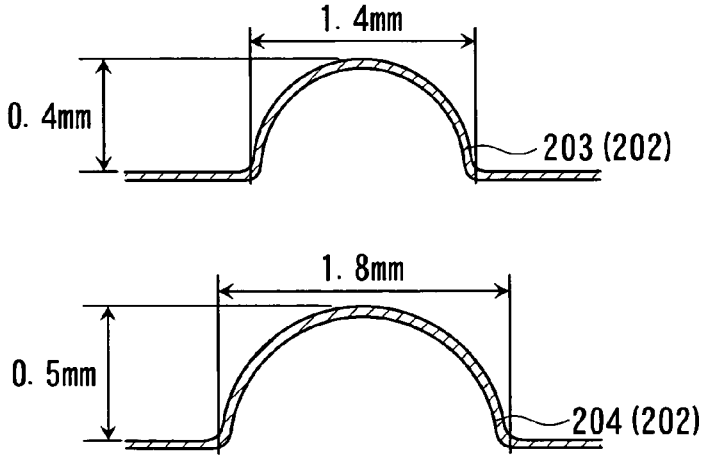

FIG. 4B shows shapes of cross sections of embossed projections 202. As shown in FIG. 4B, each of the embossed projections 202 is cylindrical with rounded corners. It is desirable that each of the embossed projections 202 be cylindrical with rounded corners since users feel smooth when touching a cylindrical embossed projection with rounded corners. However, each of the embossed projections 202 may have a semispherical, a conical, or a quadrangular pyramid shape.

In the label-making apparatus 1 according to this embodiment, two types of units, which can be selectively used, are prepared as the embossing unit 80. A unit of one type forms a small-size embossed projection 203, and a unit of the other type forms a large-size embossed projection 204. The small-size embossed projection 203 is arranged such that the diameter of a cylindrical shape is about 1.4 mm and the height of the small-size embossed projection 203 is about 0.4 mm. The large-size embossed projection 204 is arranged such that the diameter of a cylindrical shape is about 1.8 mm and the height of the large-size embossed projection 204 is about 0.5 mm.

Figure 5A:
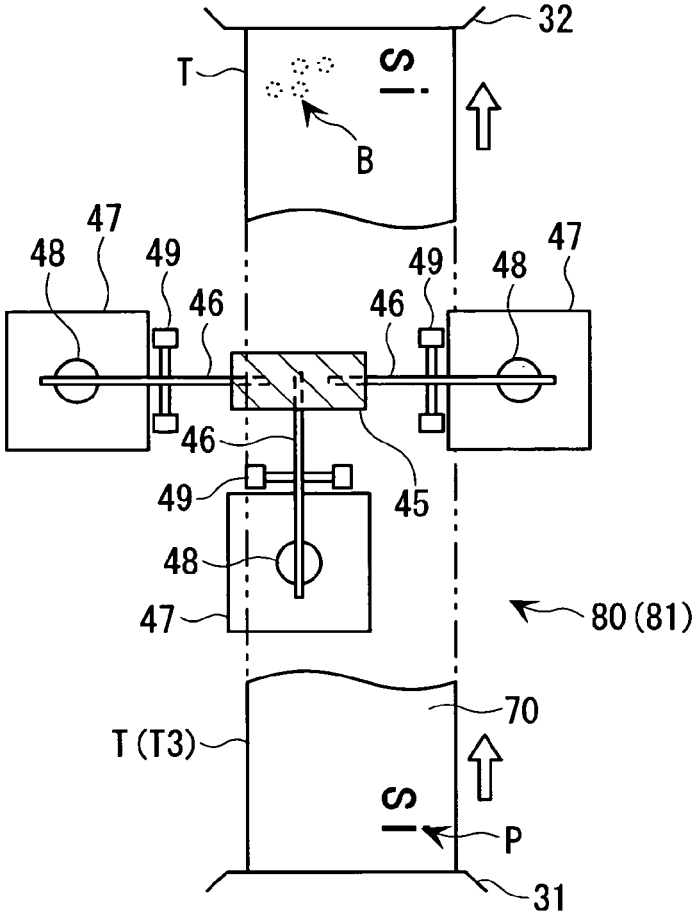
FIGS. 5A and 5B are a plan view and a cross-sectional view of an embossing unit, respectively.
Figure 5B:
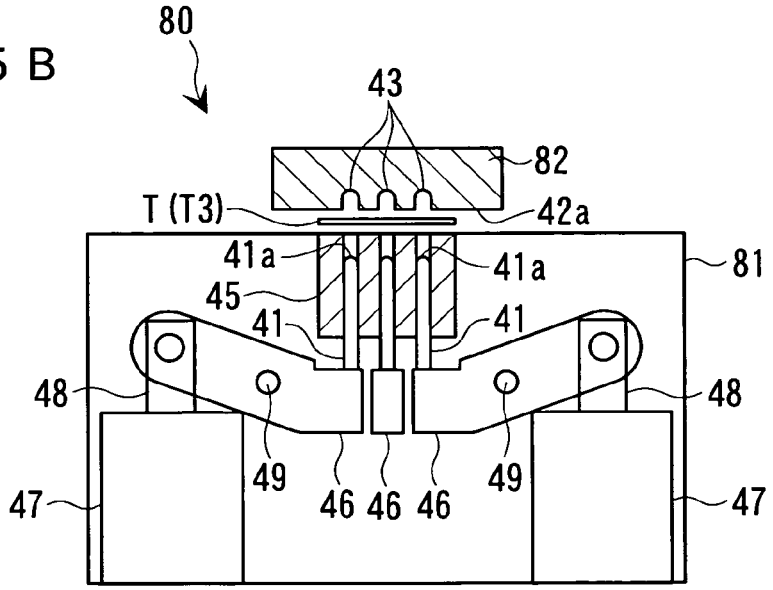

The detailed structure of the embossing unit 80 is described next with reference to FIGS. 5A and 5B. FIG. 5A is a plan view of the embossing unit 80 when seen from above, and FIG. 5B is a cross-sectional view of the embossing unit 80. FIG. 5A shows a state in which the tape T after ink character printing is performed is fed from the embossing tape insertion slot 31 to the tape-conveying path 70 by manual insertion and the tape T is fed toward the embossing tape output slot 32.

As shown in FIGS. 5A and 5B, the embossing unit 80 includes an embossing member 81 including three embossing pins 41 and a receiving member 82 that receives pushing (embossment) of the embossing pins 41. A shock-resistant spring (not shown) is built in the rear face of the receiving member 82.

The embossing member 81 includes the three embossing pins 41 arranged with intervals of 2.4 mm along the tape width direction (the horizontal direction in FIG. 5B). The embossing member 81 corresponds to three vertical embossing points from among the six embossing points 201*a* to 201*f* and is held perpendicular to the tape T by an embossing pin guide 45 that guides linear motion based on solenoids 47 as driving sources. A head 41*a* of each of the embossing pins 41 is cylindrical with rounded corners so that each of the embossed projections 202 is cylindrical with rounded corners.

One end of each of arm members 46 is semi-rigidly connected to a tail of each of the embossing pins 41. A leading edge of a plunger 48 of each of the solenoids 47 is rotatably connected to the other end of each of the arm members 46. A supporting member 49 is provided so as to rotate an intermediate portion of each of the arm members 46. The plungers 48 of the solenoids 47 are disposed in parallel to the embossing pins 41 so that the plungers 48 perform linear motion that is perpendicular to the tape T. Thus, when the plungers 48 perform linear motion with the solenoid 47, the arm members 46 rotate based on the supporting members 49 functioning as supporting points, and the embossing pins 41 perform linear motion perpendicular to the tape T from the rear side of the tape T.

Arm members 46 located on both sides extend so as to be separated in the tape width direction (the vertical direction of the tape), and an arm member 46 located in the middle extends along a feed direction of the tape T. The three solenoids 47 connected to the three arm members 46 are arranged so as to form a triangle.

A surface 42*a* of the receiving member 82 that faces the three embossing pins 41 is provided with three receiving recesses 43 corresponding to the three embossing pins 41. Each of the receiving recesses 43 has a recessed cylindrical shape with rounded corners so as to correspond to the shape of the head of each of the embossing pins 41. The surface 42*a* that faces the three embossing pins 41 may be a flat surface made of elastic materials, such as synthetic rubber, instead of forming the receiving recesses 43 in the surface 42*a*.

The embossing unit 80 forms the embossed projections 202 on the tape T by the embossing pins 41 and the receiving member 82. In other words, when the solenoids 47 are excited corresponding to braille data generated in accordance with input information and the plungers 48 are pulled, the embossing pins 41 travel in the vertical direction with respect to the tape T by being guided by the embossing pin guide 45. Then, the embossing pins 41 knock against the corresponding receiving recesses 43 with the tape T therebetween, and the embossed projections 202 are formed on the tape T.

A feed operation of the tape T in the braille-embossing section 150 is described next with reference to FIG. 6. As described above, the braille-embossing section 150 includes the embossing unit 80 that forms the embossed projections 202 on the tape T using the embossing pins 41, the tape-conveying path 70 along which the tape T is conveyed, the tape feed unit 60 that conveys the tape T along the tape-conveying path 70. In addition to them, the braille-embossing section 150 also includes guide members 71 and 72 that guide conveyance of the tape T in the tape-conveying path 70 and a transmissive leading-edge detection sensor 91 that detects the leading edge of the tape T.

A tape T1 with a tape width of 24 mm, a tape T2 with a tape width of 18 mm, and a tape T3 with a tape width of 12 mm can be selectively inserted into the embossing tape insertion slot 31. The tape T1 with the widest tape width is guided by the upper and lower guide members 72 and 71. The tapes T2 and T3 are guided by only the lower guide member 71. For example, when the tape T3 with the narrowest tape width is used, the user manually inserts the tape T3 along the lower guide member 71 until the leading edge of the tape T3 reaches the tape feed unit 60 (the feed roller 61) (to a position where the tape T3 can be inserted). Then, when the user depresses the "feed start" key on the keyboard 3, the tape feed unit 60 starts feeding the tape T3. In accordance with detection of the leading edge of the tape T3 by the leading-edge detection sensor 91 as a trigger, braille embossing processing starts (tape feeding and braille embossing based on generated braille data are performed). At this time, when a head margin from the leading edge of the tape to an embossing start position (including a half-cutting area on the leading edge side of a half-cutting position) is set to be shorter than a length L1 between the embossing unit 80 (the embossing pins 41) and the leading-edge detection sensor 91 (however, in terms of the position of the feed roller 61, it is assumed that the head margin is set to be longer than a length L2 between the embossing unit 80 and the feed roller 61), the tape T is fed back by inversely rotating the feed roller 61, and embossing and tape feeding in the forward direction start when the tape T is fed back to a proper position.

The braille embossing processing performed by the embossing unit 80 may be manually started by the user depressing the "embossing start" key on the keyboard 3, instead of being started in accordance with detection of the leading edge of the tape by the leading-edge detection sensor 91 as a trigger.

Figure 6:
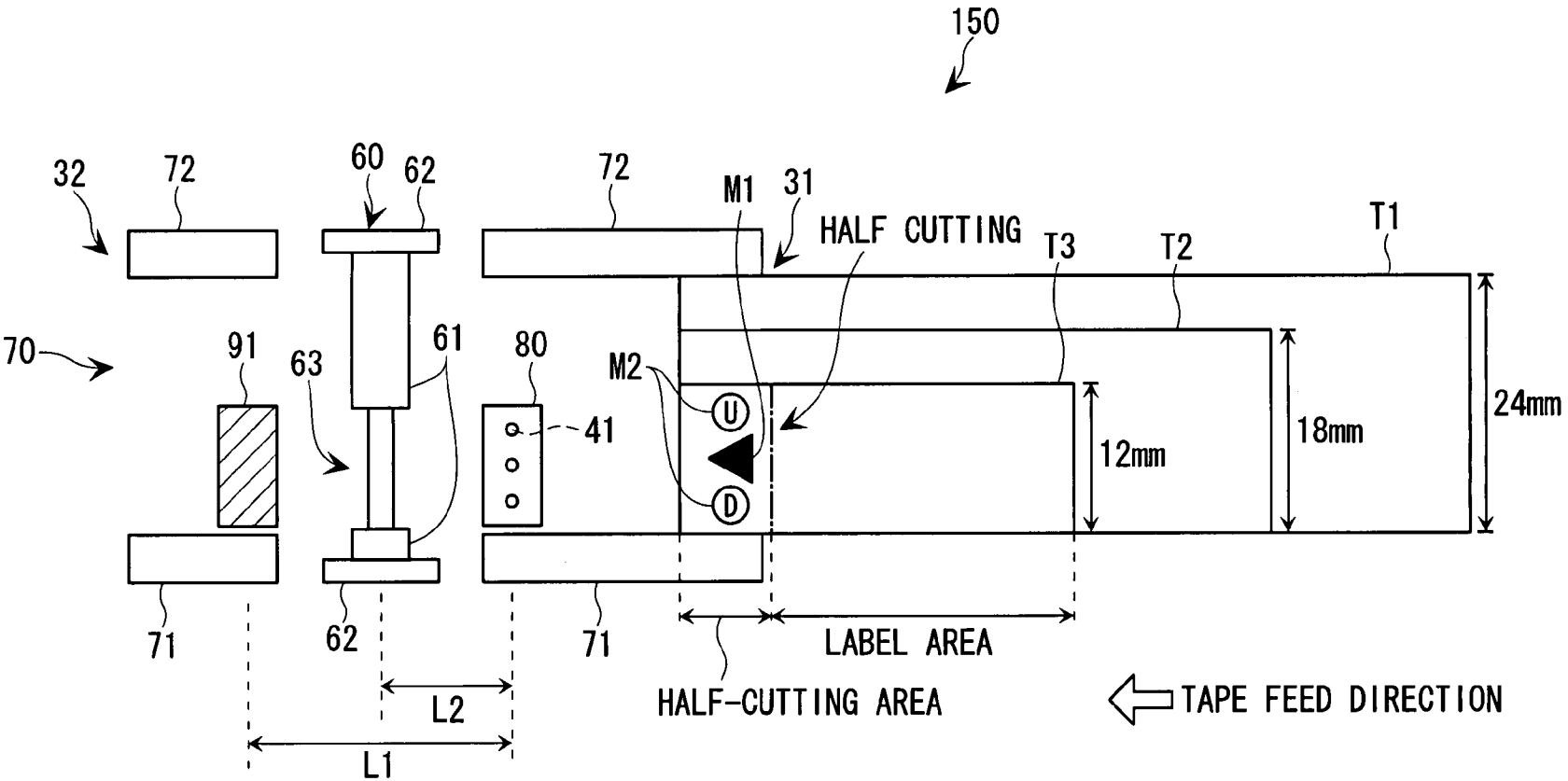
FIG. 6 illustrates tape feeding in a braille-embossing section.

As shown in FIG. 6, an insertion mark M1 that indicates a direction of insertion into the embossing tape insertion slot 31 (a direction of introduction into the tape-conveying path 70) and upper and lower marks M2 that indicate the upper and lower sides of the tape T (corresponding to the upper and lower sides of an ink character P and a braille string) are printed on the tape T by the ink character printing section 120 (see the tape T3 in FIG. 6). In addition, the insertion mark M1 and the upper and lower marks M2 are printed in the half-cutting area at the leading edge of the tape (in an area on the leading edge side of the half-cutting line) so as not to reduce the visibility of a label area (an area on the trailing end side of the half-cutting line).

Figure 7:
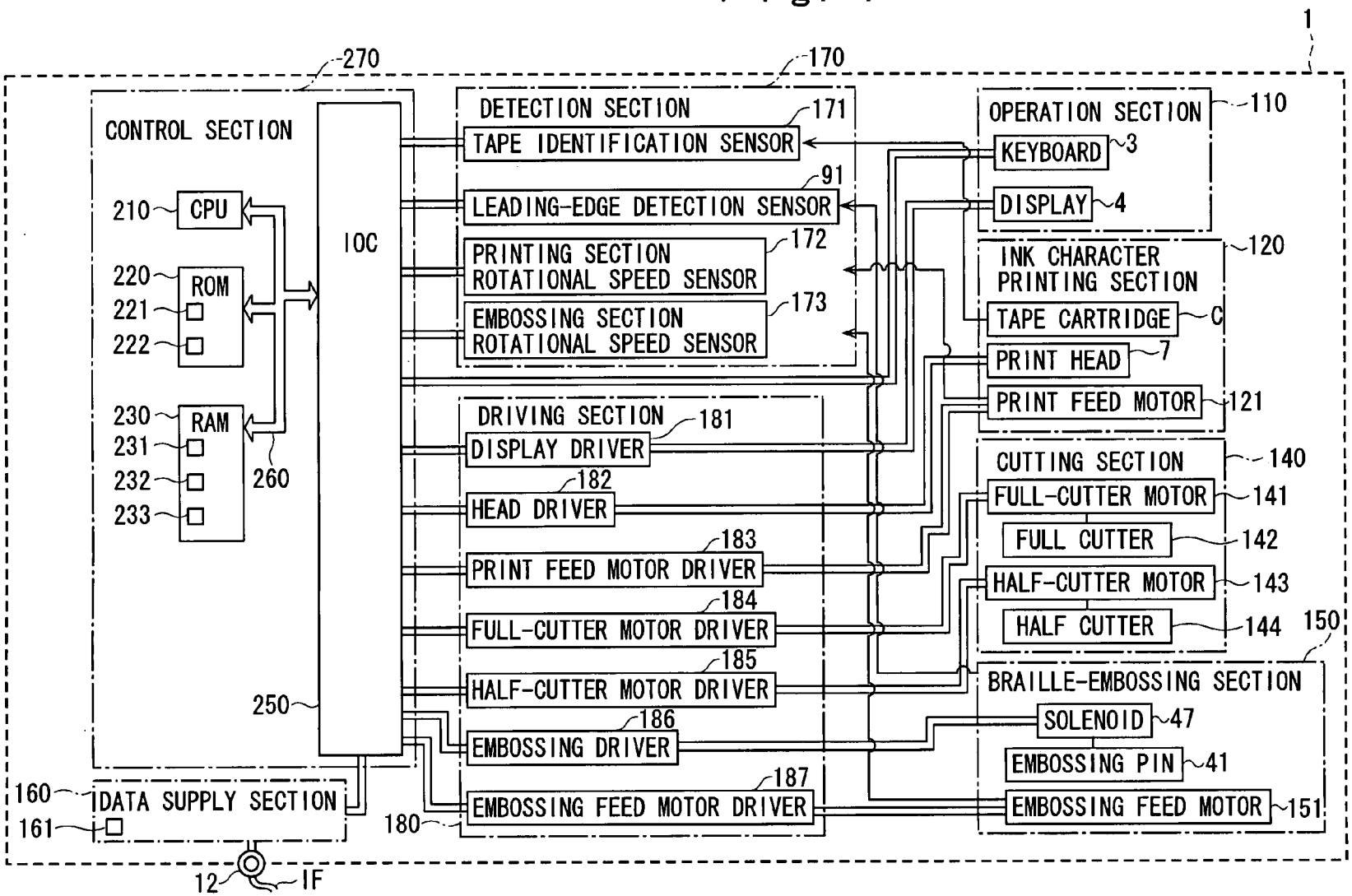
FIG. 7 is a control block diagram of the label-making apparatus.

The control structure of the label-making apparatus 1 is described next with reference to FIG. 7. The label-making apparatus 1 includes an operation section 110, the ink character printing section 120, the cutting section 140, the braille-embossing section 150, a data supply section (data server interface) 160, a detection section 170, a driving section 180, and a control section 270. The operation section 110 includes the keyboard 3 and the display 4. The operation section 110 functions as a user interface that is used by the user to input character information and that displays various types of information. The ink character printing section 120 includes the tape cartridge C, the print head 7, and the print feed motor (stepping motor) 121. The ink character printing section 120 prints ink characters based on ink character data on the tape T while conveying the tape T and the ink ribbon R. The cutting section 140 performs full cutting and half cutting. The braille-embossing section 150 includes the solenoids 47, the embossing pins 41, and the embossing feed motor (stepping motor) 151. The braille-embossing section 150 embosses braille characters based on braille data on the tape T while feeding the tape T. The data supply section 160 performs communication with the PC 501 via an interface IF and the USB connector 12. The detection section 170 includes the tape identification sensors 171 detecting the type of the tape T (tape cartridge C), the leading-edge detection sensor 91 detecting the leading edge of the tape T in the braille-embossing section 150, a printing section rotational speed sensor 172 detecting the rotational speed of the print feed motor 121, and an embossing section rotational speed sensor 173 detecting the rotational speed of the embossing feed motor 151. The detection section 170 performs various types of detection. The driving section 180 includes a display driver 181, a head driver 182, a print feed motor driver 183, cutter motor drivers 184 and 185, an embossing driver 186, and an embossing feed motor driver 187. The driving section 180 drive-controls each section. The control section 270 is connected to each section and controls the entire label-making apparatus 1.

The cutting section 140 is provided downstream in the tape feed direction of the ink character printing section 120. In the cutting section 140, a full cutter 142 and a half cutter 144 are disposed adjacent to the cartridge-mounting section 6 and face the tape-conveying path (not shown) (see the cutting mechanism 19 in FIG. 3). The full cutter 142 and the half cutter 144 are driven by the full-cutter motor 141 and the half-cutter motor 143, respectively. The full cutter 142 is a scissors-type cutter including a fixed blade and a movable blade and cuts both the laminated recording sheet and peel sheet. The half cutter 144 is a push-cut type cutter and cuts only the recording sheet.

The data supply section 160 includes a buffer 161 for receiving various data, such as ink character data and braille data, from the PC 501 and for transmitting a status. The data supply section 160 communicates with the PC 501 in accordance with the USB specifications (protocol).

The control section 270 includes a central processing unit (CPU) 210, a read-only memory (ROM) 220, a random-access memory (RAM) 230, and an input/output controller (IOC) 250. The CPU 210, the ROM 220, the RAM 230, and the IOC 250 are connected to one another via an internal bus 260. The ROM 220 includes a control program block 221 that stores a control program for controlling various types of processing, such as ink character printing and braille embossing, by the CPU 210 and a control data block 222 that stores various data, such as character font data for performing ink character printing and braille font data for performing braille embossing. The character font data may be stored in a CG-ROM, which is separately provided, instead of being stored in the ROM 220.

The RAM 230 includes various work area blocks 231 used as a flag and the like. The RAM 230 also includes an ink character printing data block 232 that stores ink character printing data based on ink character data received from the PC 501 and a braille embossing data block 233 that stores braille embossing data that is based on braille data received from the PC 501 and that represents embossing or non-embossing of each of the embossing points 201*a* to 201*c* or each of the embossing points 201*d* to 201*f* for each embossing column. The RAM 230 is used as a work area for control processing. In addition, the RAM 230 is always backed up so that the stored data is kept in case of power failure A logic circuit that includes a gate array, a custom large-scale integrated (LSI) circuit, and the like is built in the IOC 250. The logic circuit complements the feature of the CPU 210 and handles interface signals for various peripheral circuitries. The IOC 250 loads to the internal bus 260 input data and control data received from the keyboard 3 and the data supply section 160 after processing the data or without processing the data. In addition, the IOC 250 is operatively connected to the CPU 210 to output to the driving section 180 the data and the control signal output from the CPU 210 to the internal bus 260 after processing the data or without processing the data.

With the above-mentioned structure, the CPU 210 receives various signals and data from each section of the label-making apparatus 1 via the IOC 250 in accordance with a control program stored in the ROM 220. In addition, the CPU 210 processes various data stored in the RAM 230 in accordance with the received signals and data, and outputs the various signals and data to each section of the label-making apparatus 1 via the IOC 250. Accordingly, the CPU 210 controls ink character printing and braille embossing.

A general process for making an ink character label LB1 and a braille label LB2 is described next with reference to FIGS. 8A and 8B. The ink character label LB1 is a label on which an ink character P is printed. The braille label LB2 is a label on which the ink character P is printed and a braille character B is embossed.

Figure 8A:
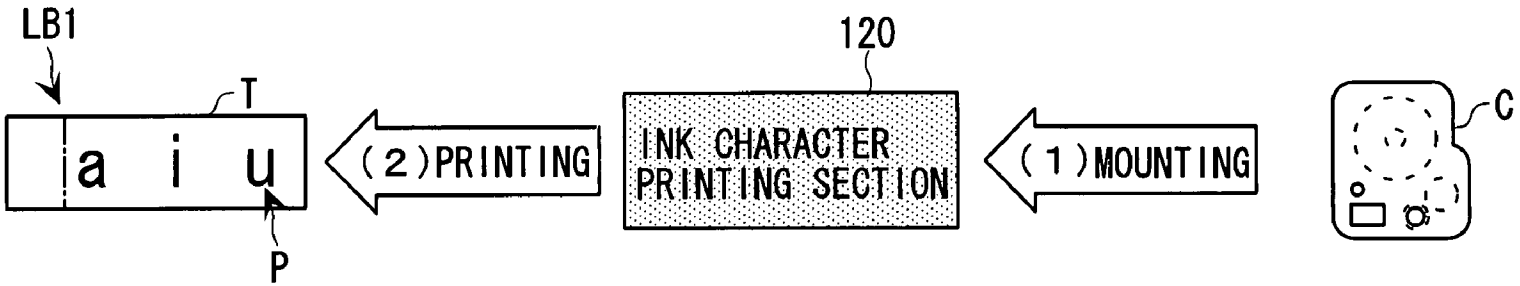
FIGS. 8A and 8B show a general process for making an ink character label and a general process for making a braille label, respectively.

When the ink character label LB1 is made (when only ink character data is received from the PC 501), a process shown in FIG. 8A is performed. First, the tape cartridge C is mounted (processing 1). Then, ink characters P are printed on the tape T fed from the mounted tape cartridge C to the ink character printing section 120 in accordance with the ink character data received from the PC 501 (processing 2), and the tape T after printing processing (the ink character label LB1) is output. Although half cutting is performed at a leading edge of the tape T in processing 2, the insertion mark M1 or the upper and lower marks M2 (see FIG. 6) is not printed. When ink character labels LB1 are made, means for designating whether or not to perform half cutting may be provided in the PC 501 or the label-making apparatus 1.

Figure 8B:
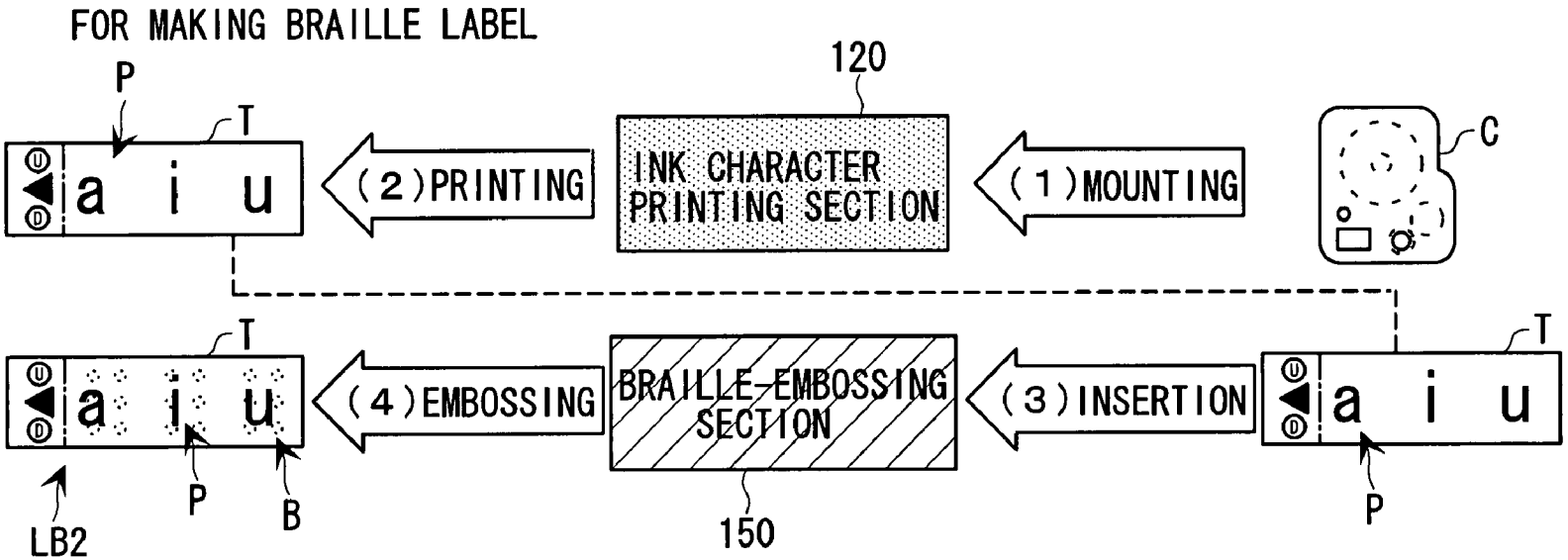

When the braille label LB2 is made (when data including braille data is received from the PC 501), a process shown in FIG. 8B is performed. First, the tape cartridge C is mounted (processing 1). Then, ink characters P are printed on the tape T fed from the mounted tape cartridge C to the ink character printing section 120 (processing 2), and the tape T after printing processing is output. At this time, the ink character printing section 120 prints the insertion mark M1 and the upper and lower marks M2 in a half-cutting area, and performs half cutting (see FIG. 6). The tape T after ink character printing is manually inserted in accordance with the insertion mark M1 (processing 3). The inserted tape T is fed to the braille-embossing section 150, and braille characters B are embossed on the tape T in accordance with the braille data received from the PC 501 (processing 4). The made braille label LB2, on which the ink characters P are printed and the braille characters B are embossed, is attached to an object in accordance with the upper and lower marks M2 and used.

When only braille embossing is performed on the braille label LB2, blind printing is performed in processing 2. In other words, a blank label having a predetermined length is made such that only the insertion mark M1 and the upper and lower marks M2 are printed in a half-cutting area.

In the example shown in FIG. 8B, the braille label LB2 is made using the tape T3 with a width of 12 mm (see FIG. 6). Thus, in FIG. 8B, the ink characters P are printed and the braille characters B are embossed such that the ink characters P and the braille characters B overlap each other. When the tape T1 with a width of 24 mm or the tape T2 with a width of 18 mm is used, positions of an ink character printing area Ep and a braille embossing area Eb in the tape width direction can be set in layout creation processing (see step S6 in FIG. 10) performed by the PC 501.

Figure 9A:
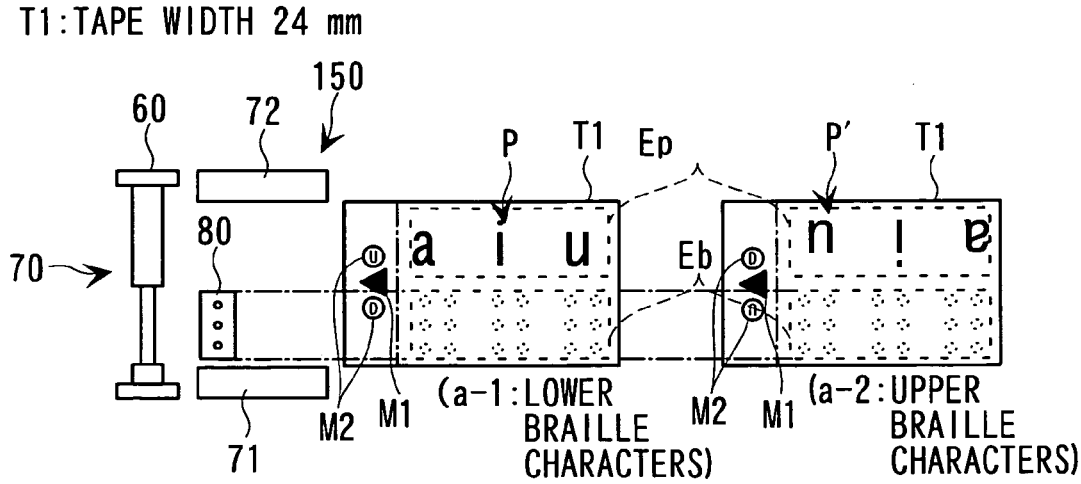
FIGS. 9A to 9C illustrate setting of the position of an ink character printing area and the position of a braille embossing area.
Figure 9B:
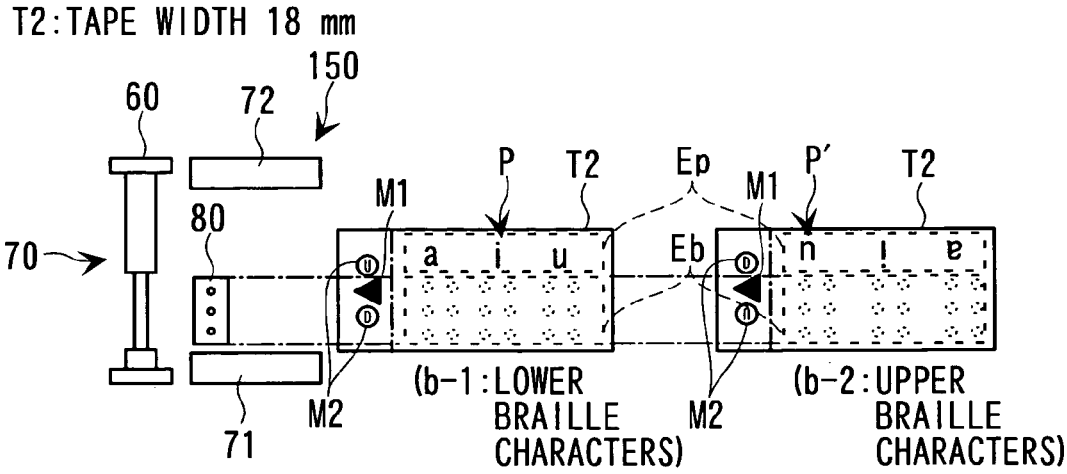
Figure 9C:
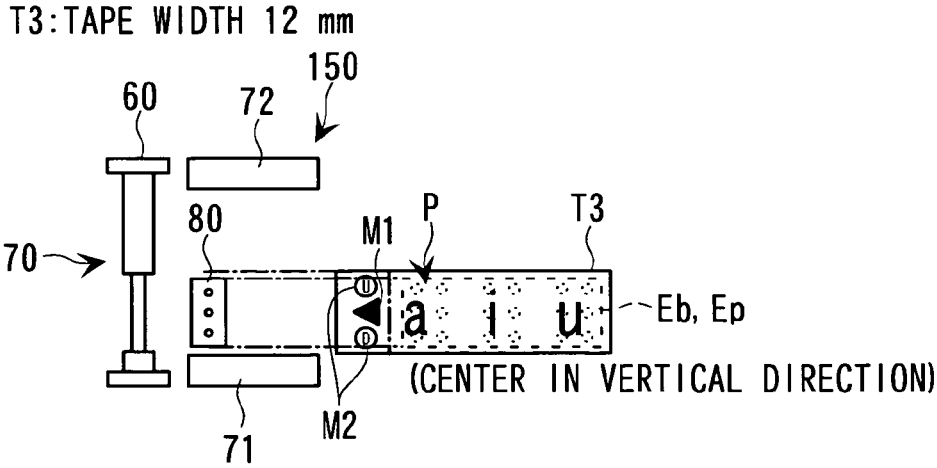

Positions to which the ink character printing area Ep and the braille embossing area Eb can be set in the tape width direction is described next with reference to FIGS. 9A to 9C. FIGS. 9A to 9C show the tapes T1, T2, and T3, respectively, after ink character printing and before insertion into the braille-embossing section 150. In the explanation below, the upper and lower sides of the tape T are defined by the upper and lower sides of the ink character P and a braille string and the upper and lower marks M2.

As shown in FIG. 9A, when a tape width of 24 mm (the tape T1) is detected as a result of detection by the tape identification sensors 171 (see FIG. 7), the braille embossing area Eb can be set to a lower portion (a-1) or an upper portion (a-2). The PC 501 transmits braille data including data (command) indicating a braille position (a lower braille character or an upper braille character) to the label-making apparatus 1, and the label-making apparatus 1 determines the position of a braille character in accordance with the data indicating the braille position. When the braille embossing area Eb is set to the lower portion (a-1) (when it is determined to be a lower braille character), ink character printing data within the ink character printing data block 232 and braille embossing data within the braille embossing data block 233 are read, and printing and embossing are performed in the forward direction (printing and embossing are performed from the leading edge side of each of the ink character printing data and the braille embossing data). When the braille embossing area Eb is set to the upper portion (a-2) (when it is determined to be an upper braille character), ink character printing data within the ink character printing data block 232 and braille embossing data within the braille embossing data block 233 are read from the trailing edge side (reversal processing is performed), and printing and embossing are performed (reverse ink characters P' and reverse braille characters B' obtained by rotating the ink character printing data and the braille embossing data 180 degrees are printed and embossed). Since the embossing unit 80 faces a position near the lower side of the tape-conveying path 70 (see FIG. 6), when braille embossing is performed in an upper portion of the tape T (when an upper braille character is embossed), the tape T is inserted from the trailing edge side (from the right side when the upper and lower sides are defined in accordance with a ink character P and a braille string) such that the braille embossing area Eb faces the embossing unit 80 (see the upper braille character a-2 in FIG. 9A).

In addition, as shown in FIG. 9B, when a tape width of 18 mm (the tape T2) is detected, the braille embossing area Eb can be set to the lower portion (b-1) or the upper portion (b-2). When a lower braille character (b-1) is set, ink character printing data and braille embossing data are printed and embossed in the forward direction. When an upper braille character (b-2) is set, ink character printing data and braille embossing data are rotated 180 degrees, and the rotated ink character printing data and braille embossing data are printed and embossed.

When a tape width of 12 mm (the tape T3) is detected, since this tape width is the shortest size for embossing for the braille cell 200 (the length in the tape width direction) (see FIG. 4A), the braille embossing area Eb is disposed at the center in the vertical direction. In other words, when the tape width is set to 12 mm, in the layout creation processing performed by the PC 501, the position of the braille embossing area Eb in the tape width direction is fixed (selection between an upper braille character and a lower braille character cannot be performed). Thus, when the tape width of 12 mm is detected, ink character printing data and braille embossing data are always printed and embossed in the forward direction.

In the example described above, the PC 501 transmits braille data including data indicating a braille position to the label-making apparatus 1, and the label-making apparatus 1 determines, in accordance with the data indicating the braille position, whether to print and emboss ink character printing data and braille embossing data in the forward direction or to rotate ink character printing data and braille embossing data 180 degrees and print and emboss the rotated ink character printing data and braille embossing data. However, the PC 501 may perform such reverse processing of data. In other words, for a lower braille character (for a case where the braille embossing area Eb is set to a lower portion of a tape), the PC 501 transmits ink character data and braille data in the forward direction. For an upper braille character (for a case where the braille embossing area Eb is set to an upper portion of a tape), the PC 501 rotates ink character data and braille data 180 degrees and transmits the rotated ink character data and braille data. With this configuration, the label-making apparatus 1 does not need to determine a braille position. Since the label-making apparatus 1 only needs to print and emboss data received from the PC 501 without any processing, easier control can be achieved.

In addition, the ink character printing area Ep is not necessarily set to the position shown in FIGS. 9A, 9B, or 9C. For example, the ink character printing area Ep may be set to a position so as to overlap the braille embossing area Eb or the entire area in the tape width direction may be set as the ink character printing area Ep. In addition, the number of ink character printing areas set on the tape T is not necessarily one. A plurality of ink character printing areas may be set on the tape T. Instead of arranging ink characters P as a unit of area, ink characters P may be input and arranged in any position on the tape T as a normal text TX (see FIGS. 15A and 15B).

A layout creation process when positions of the ink character printing area Ep and the braille embossing area Eb are set in accordance with an ink character object OB1 and a braille object OB2 (see FIGS. 15A and 15B) and ink characters P can be input and arranged as a normal text TX will be described with reference to FIGS. 10, 11A, 11B, 12A, 12B, 13A, 13B, 14A, 14B, 14C, 15A and 15B.

Figure 10:
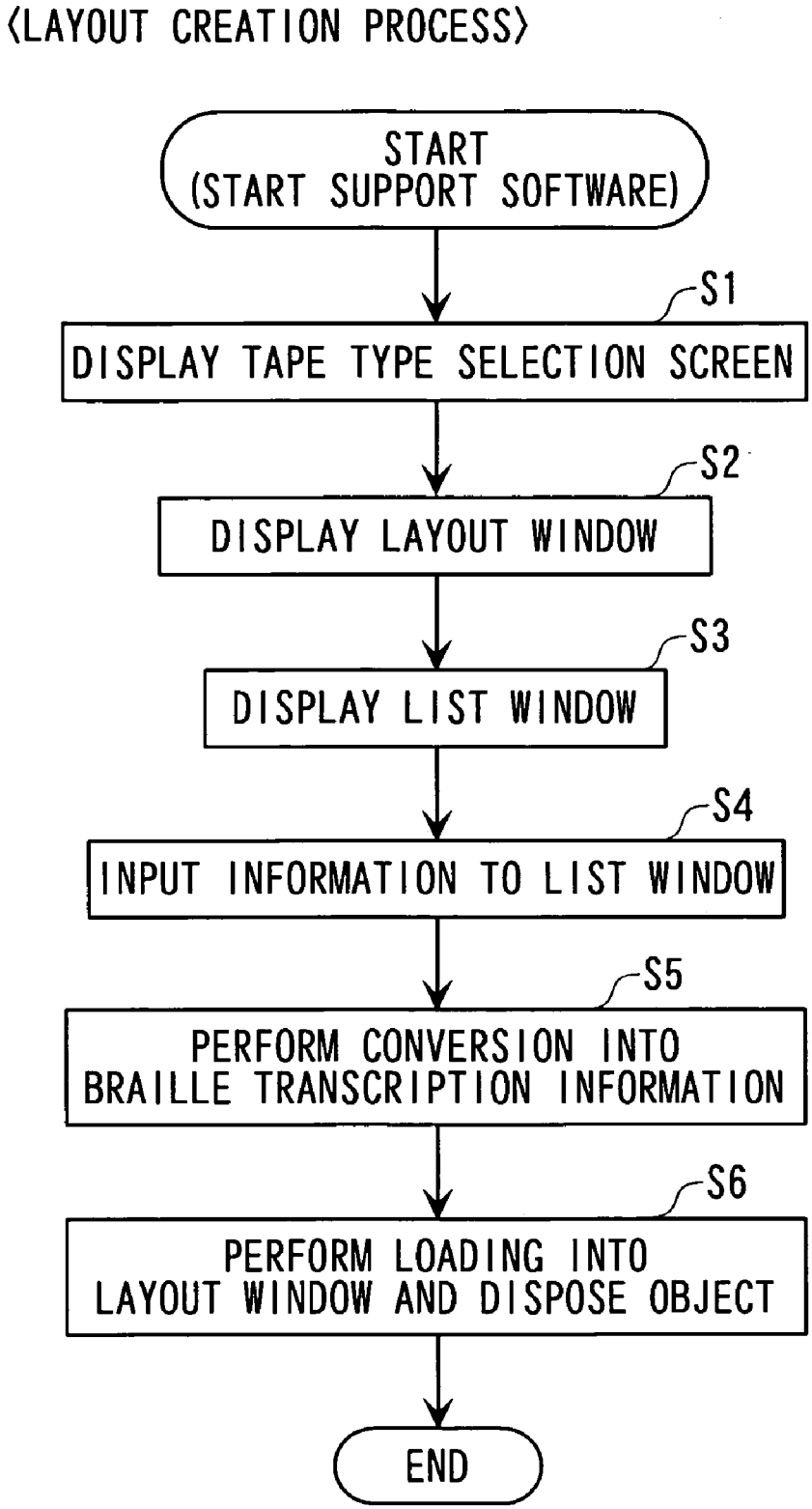
FIG. 10 is a flowchart showing a layout creation process.
Figure 14A:
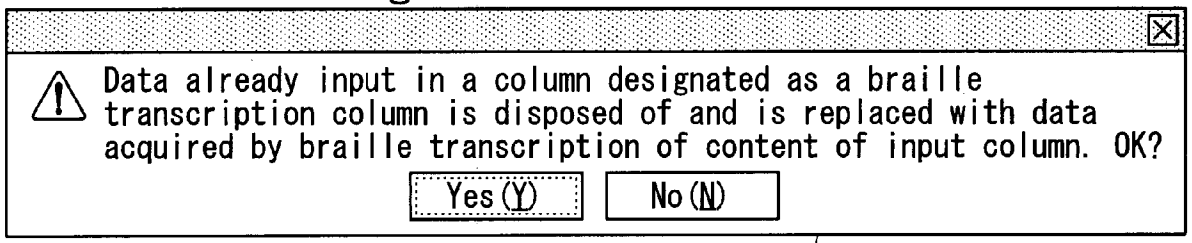
FIGS. 14A to 14C illustrate examples of message boxes.
Figure 14B:
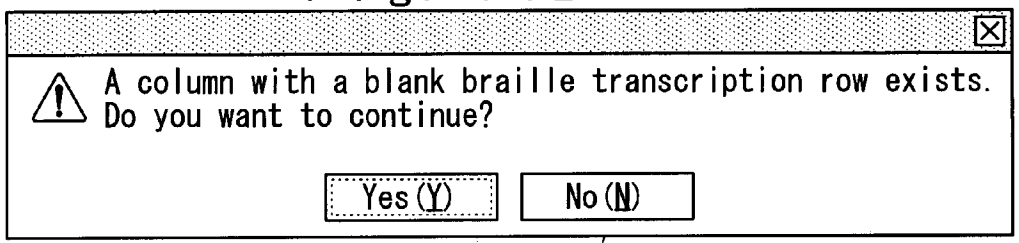
Figure 14C:
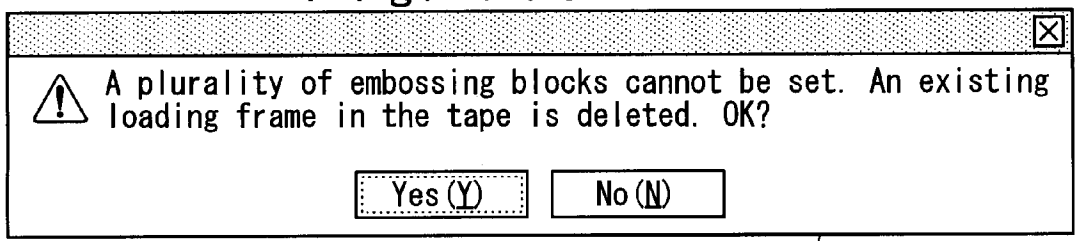
Figure 15A:
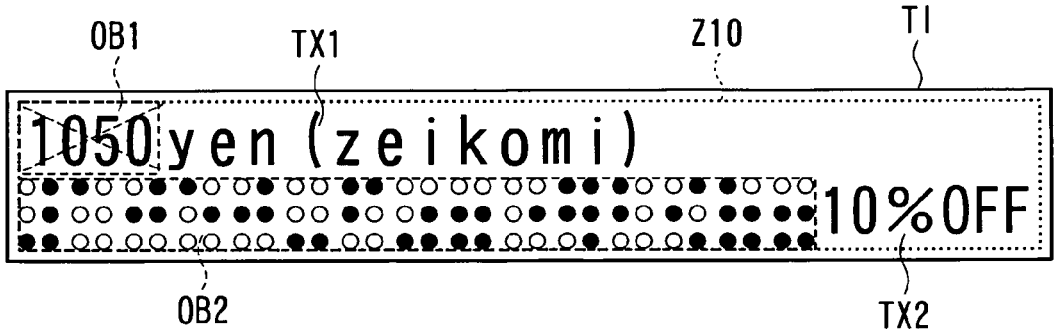
FIGS. 15A and 15B illustrate a process for changing the size of a braille object frame.
Figure 15B:
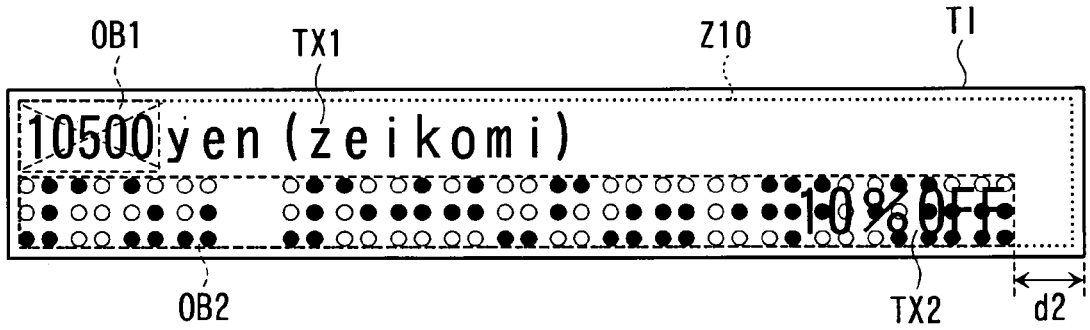

FIG. 10 is a flowchart showing the layout creation process performed by the PC 501. FIGS. 11A, 11B, 12A, 12B, 13A, and 13B illustrate transition of screens displayed on a display D of the PC 501 (see FIG. 1) when the layout creation process is performed. FIGS. 14A to 14C show examples of message boxes MB displayed when the layout creation process is performed. FIGS. 15A and 15B show examples of the layout in an image of the tape T.

A general flow of the layout creation process is described next. Referring to FIG. 10, when support software for executing the layout creation process starts in accordance with a predetermined user operation, a screen (not shown) for selecting a tape type is displayed (step S1). Here, a tape width (12 mm, 18 mm, or 24 mm), a margin (small, medium, large, or value setting), and a tape length (fixed (value setting) or automatic) can be set. For the tape width, automatic setting can be performed by clicking a button on the screen for acquiring a tape width. In other words, by transmitting a predetermined command for acquiring a tape width from the PC 501 to the label-making apparatus 1, a value obtained by detection and identification performed by the tape identification sensors 171 of the label-making apparatus 1 (see FIG. 7) can be acquired.

When a tape type is selected, a layout window W1 (see FIG. 11A) is displayed (step S2). An image TI of the tape T (hereinafter, referred to as a tape image TI) is displayed in the layout window W1. When an ink character object OB1 and a braille object OB2 are disposed, the ink character object OB1 and the braille object OB2 are also displayed in the layout window W1 (see FIG. 13B).

Then, in accordance with a predetermined user operation, a list window W2 is displayed (S3). The list window W2 is a screen for inputting information for loading object data, such as a braille pattern and an ink character image, into frames (object frames) of the ink character object OB1 and the braille object OB2. "Loading" means sequentially incrementing information listed in the list window W2 for each information reading and importing the information into the frame of the braille object OB2.

Information functioning as originals of a braille pattern and an ink character image is input to the list window W2 (step S4). Original text information is input as information functioning as an original of a braille pattern (see column B in the list window W2 in FIG. 11B). The original text information is not a document written in braille based on notation with a space between words. The original text information is a normal document (text data). Ink character information, which is a normal document, is input as information functioning as an original of an ink character image (see column A in the list window W2 in FIG. 11B).

Then, conversion into braille transcription information is performed (step S5). The conversion into braille transcription information means converting original text information into braille transcription information in accordance with braille notation. The conversion is performed in accordance with a braille editor included in support software and does not provide 100 percent accuracy. Thus, editing in the list window W2 can be performed in an appropriate manner (see column C in the list window W2 in FIG. 13A).

After completing the conversion into the braille transcription information, loading into the layout window W1 is performed, and the ink character object OB1 and the braille object OB2 are disposed (step S6). For a braille character, in the loading processing, braille transcription information is converted into a braille pattern, which represents embossing or non-embossing of each embossing point of the braille characters and the braille pattern is imported into the frame of the braille object OB2. For an ink character, in the loading processing, ink character information is imported into the frame of the ink character object OB1 in a predetermined font (see FIG. 13B). The ink character object OB1 and the braille object OB2 are disposed by dragging (moving) and dropping the ink character object OB1 and the braille object OB2 into desired positions in the tape image TI (however, the position of the braille object OB2 is limited).

In accordance with the above-described process, a layout is created. However, both the ink character object OB1 and the braille object OB2 are not necessarily disposed. Only one of the ink character object OB1 and the braille object OB2 may be disposed. Instead of converting input original text information into braille transcription information, braille transcription information may be directly input. Instead of performing loading from the list window W2, the braille object OB2 may be individually created by performing processing of inputting original text information, performing conversion into braille transcription information and a braille pattern, and creating the braille object OB2 and the ink character object OB1 may be individually created by inputting ink character information.

Figure 11A:
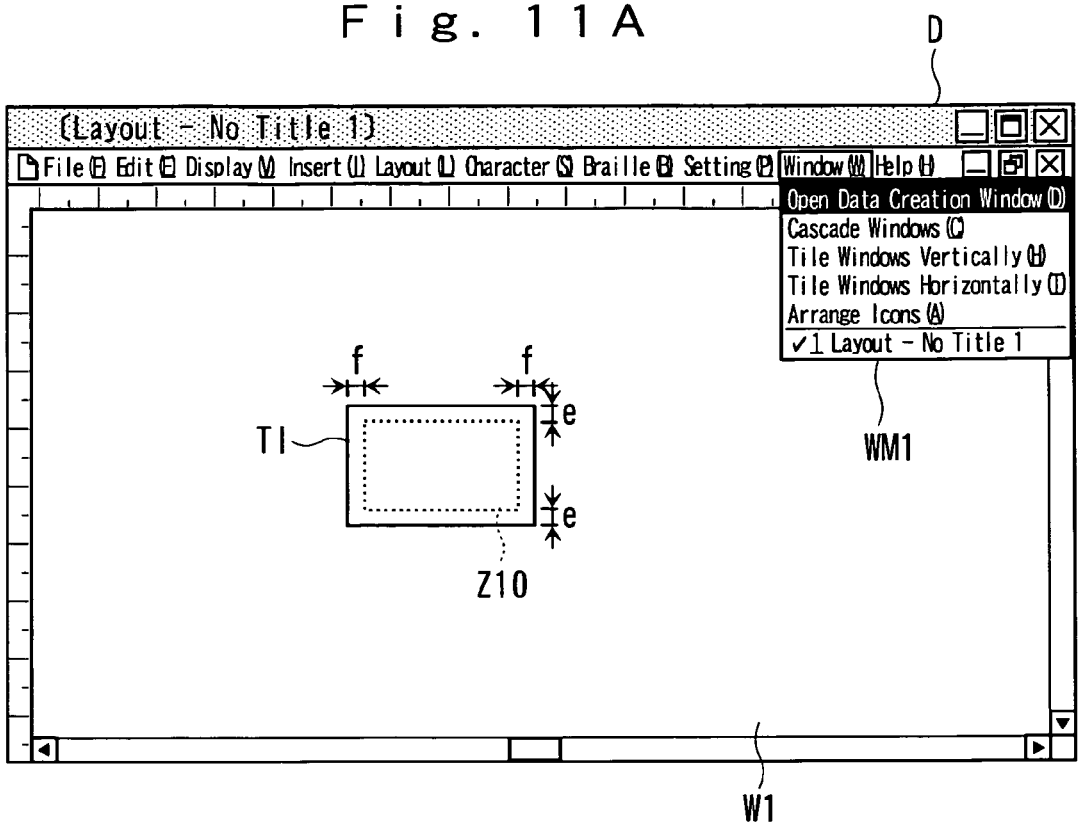
FIGS. 11A and 11B illustrate a part of the layout creation process in accordance with transition of screens.
Figure 11B:
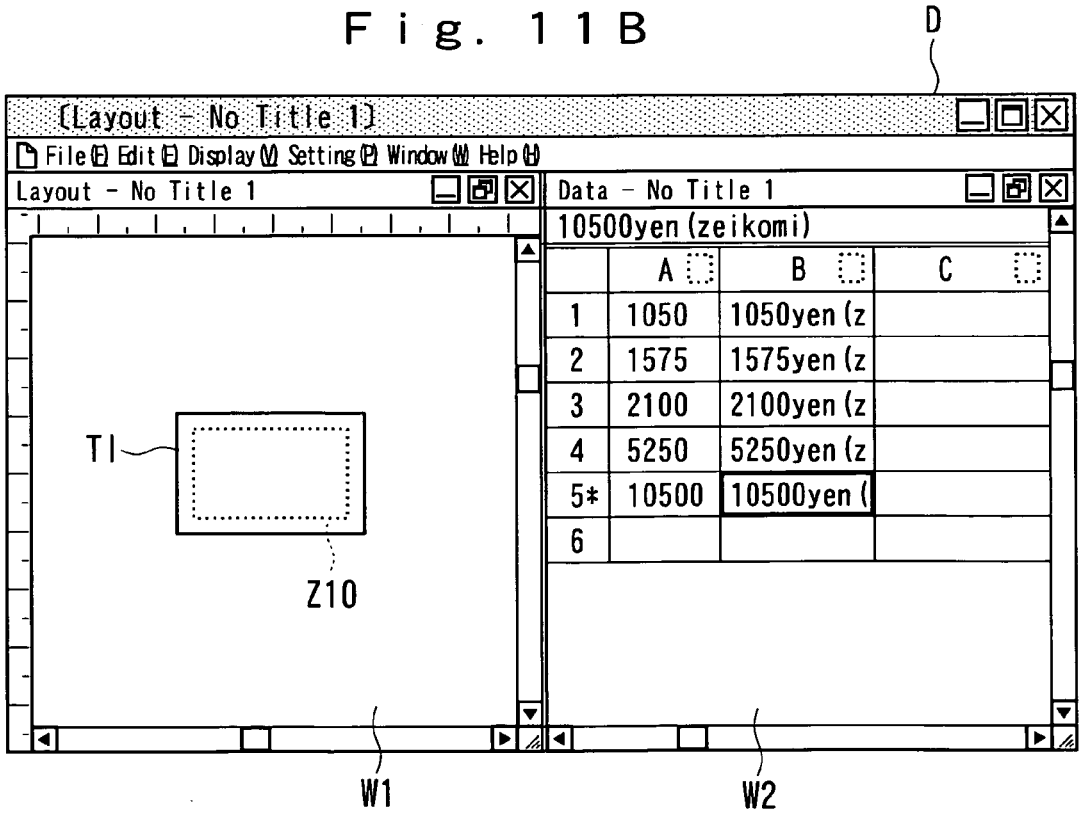

The layout creation process is described next in accordance with transition of screens with reference to FIGS. 11A, 11B, 12A, 12B, 13A, 13B, 14A, 14B, 14C, 15A, and 15B. FIG. 11 A shows a screen on which the layout window W1 is displayed (step S2 in FIG. 10) after a tape type is selected (step S1 in FIG. 10). A tape width of 24 mm (the tape T1, see FIG. 6) and a tape length of "automatic" are set as the tape type. In this example, the tape image TI of the tape T1 is displayed at the center of the screen. Although, for easier understanding of an explanation, an outer frame of a printable area Z10 is represented inside the tape image TI by the doted line in FIG. 11A, only the tape image TI is actually displayed. The printable area Z10 represents an area in which printing can actually be performed. The printable area Z10 does not limit the position of the ink character object OB1. In other words, the ink character object OB1 can be disposed in any position. When the ink character object OB1 is disposed so as to cross the outer frame of the printable area Z10, only information within the printable area Z10 is to be printed. In addition, the printable area Z10 is an area including embossable areas Z11 and Z12 (see FIGS. 17A and 17B) in which the braille object OB2 can be disposed (braille embossing can actually be performed). The printable area Z10 (an area that is within the tape image TI and that includes the embossable areas) will be described as an effective forming area.

As shown in FIG. 11A, the printable area (effective forming area) Z10 has a rectangular shape having sides away from the tape image TI by e in the tape width direction and sides away from the tape image TI by f in the tape length direction. The lengths of e and f are set by a printing mechanism, a feed mechanism, and the like. Sizes of the tape image TI and the printable area (effective forming area) Z10 displayed on the initial screen are set to predetermined values in advance. However, the sizes of the tape image TI and the printable area (effective forming area) Z10 can be changed in accordance with the sizes and positions of the object frames (the loading frames of the ink character object OB1 and the braille object OB2).

When "Open Data Creation Window" is selected from a window menu WM1 in FIG. 11A, the layout window W1 and the list window W2 are displayed side by side, as shown in FIG. 11B. In this example, the layout window W1 is displayed in a left-half area of the display D, and the list window W2 is displayed in a right-half area of the display D. The ratio of these areas can be changed by a user operation. In addition, data can be stored for each of the layout window W1 and the list window W2.

As shown in FIG. 11B, in the list window W2, ink character information and original text information are input in cells in columns A and B, respectively. Information input in columns A and B may not be associated with each other. Information input in the same column may be used as ink character information and original text information. In addition, an asterisk mark added to the row number "5" in the fifth row indicates that original text information ("10500 yen (zeikomi)" in column B) input in a cell in that row is to be loaded to the braille object OB2. In addition, enclosing the cell within a thick frame represents that the cell is to be edited.

Figure 12A:
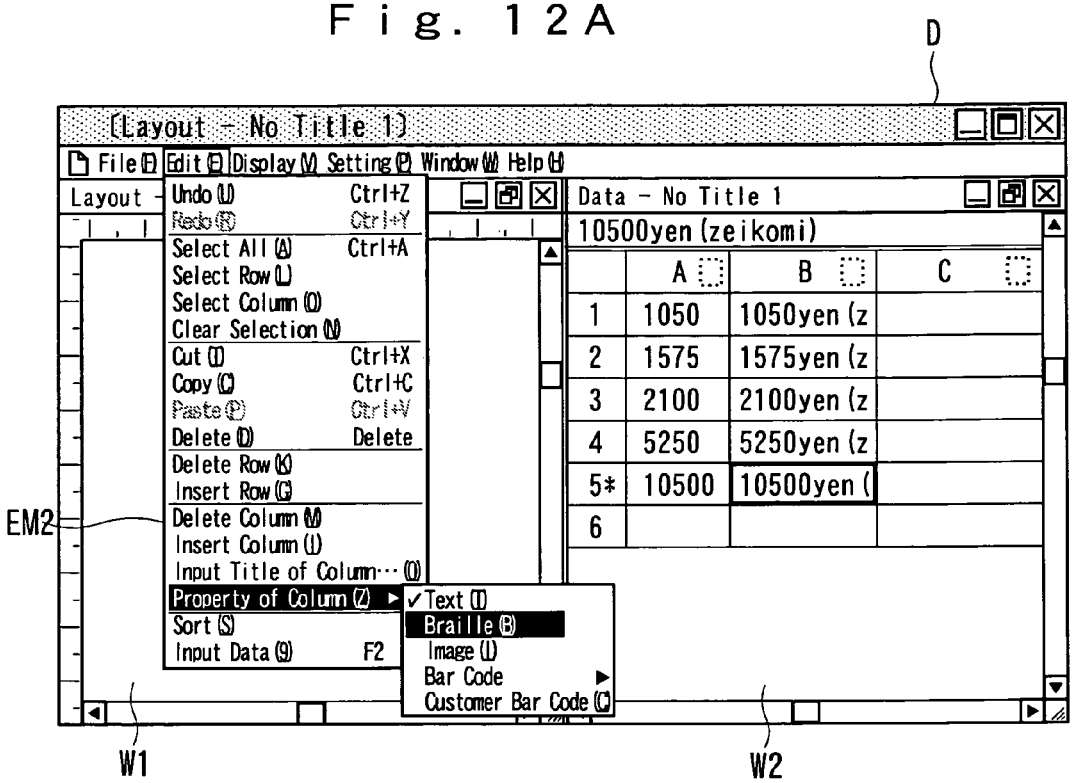
FIGS. 12A and 12B illustrate the next part of the layout creation process shown in FIGS. 11A and 11B.

After completion of input to the list window W2, in order to display a braille property dialog box DB (see FIG. 12B), "Property of Column" and "Braille" are selected from an editing menu EM2, as shown in FIG. 12A. If "Text", "Image", "Bar Code", or the like, which is other than "Braille" is selected, a column to be loaded to the ink character object OB1 is designated. If "Bar Code" is selected, a bar-code image obtained by bar-coding a designated column is loaded to the ink character object OB1.

Figure 12B:
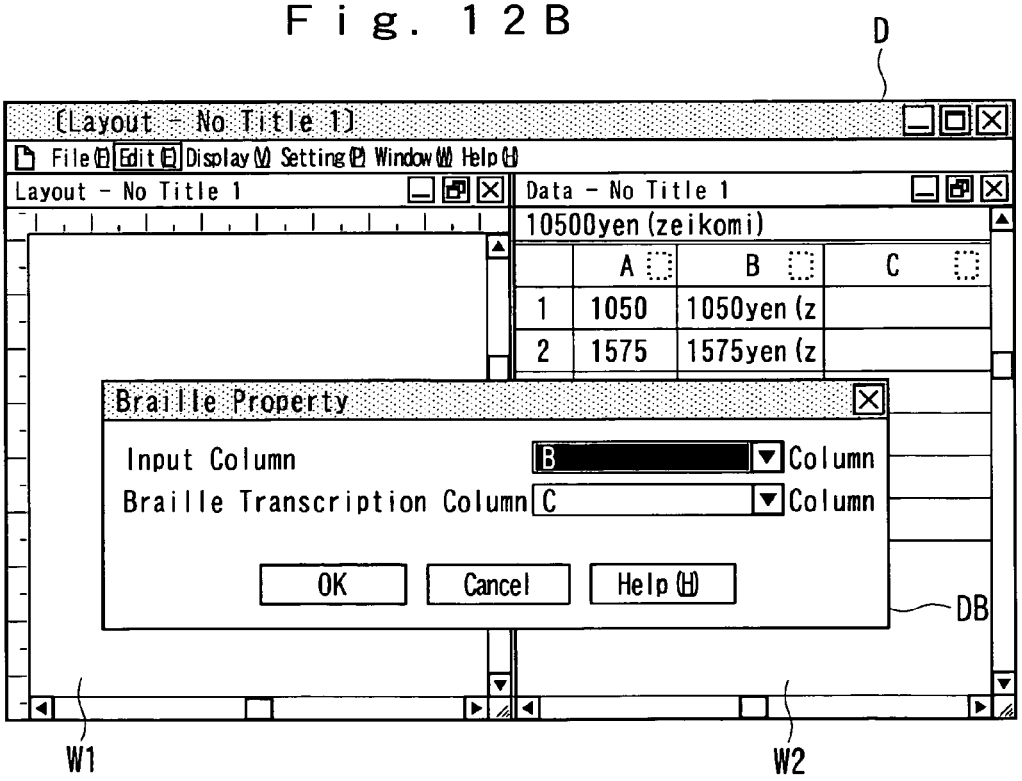

As shown in FIG. 12B, in the braille property dialog box DB, an "input column" in which original text information is listed and a "braille transcription column" in which braille transcription information obtained by braille transcription of the original text information is listed can be designated. In this example, since original text information is input to column B (see FIG. 11B), column B is designated as an "input column", and column C, which is next to column B, is designated as a "braille transcription column".

If there is originally input information in a column designated as a braille transcription column (in this case, column C), a message box MB1 indicating that the information originally input in the braille transcription column is replaced with data (braille transcription information) acquired by braille transcription of original text information (column B) is displayed, as shown in FIG. 14A. If "No" is selected in the message box MB1, the braille property dialog box DB is displayed again to urge the user to designate a braille transcription column.

If "Yes" is selected in the message box MB1, before overwriting braille transcription information, it is determined whether or not the number of transcribed characters exceeds the number of embossable characters. If the number of transcribed characters exceeds the number of embossable characters, a message box MB2 indicating that a blank column due to no braille transcription exists is displayed, as shown in FIG. 14B. Here, "the number of embossable characters" means an upper limit of the number of continuously embossed characters for which normal driving of the solenoids 47 (see FIGS. 5A and 5B) for driving the embossing unit 80 is ensured. More specifically, the number of embossable characters is set to about 50 characters. If "No" is selected in the message box MB2, overwriting of braille transcription information stops.

If "Yes" is selected in the message box MB2, it is determined whether or not a braille object OB2 exists in the layout window W1. If a braille object OB2 exists in the layout window W1, a message box MB3 indicating that the existing frame of the braille object OB2 (loading frame) in the tape is deleted is displayed, as shown in FIG. 14C. This is because the number of braille objects OB2 disposed in a tape image TI is limited to one. If "No" is selected in the message box MB3, the braille property dialog box DB is displayed again.

Figure 13A:
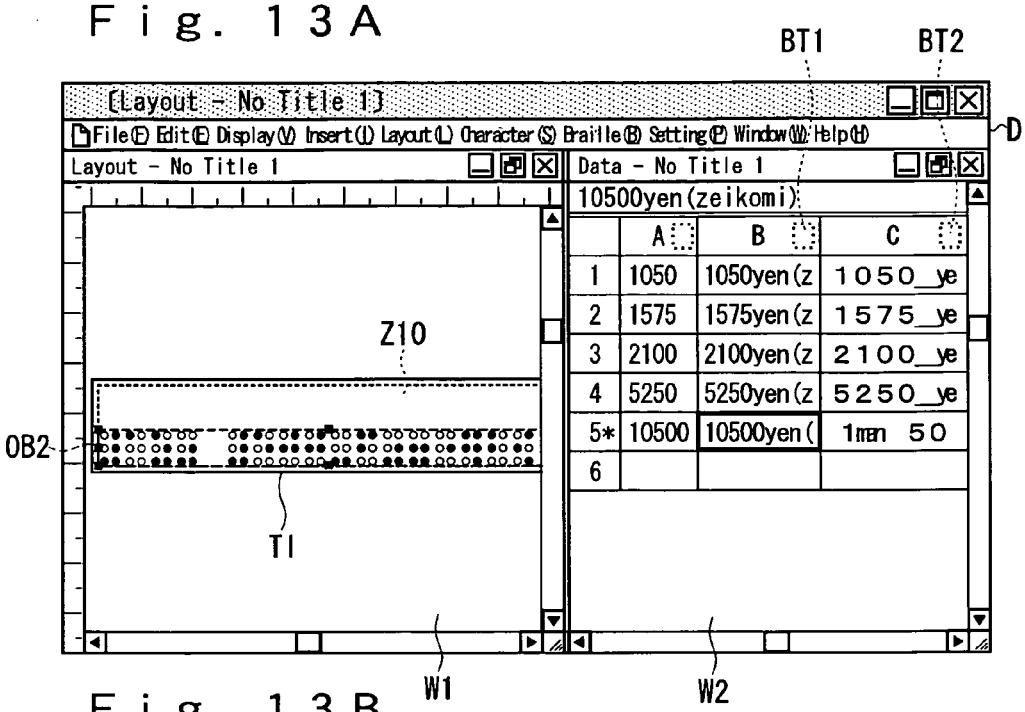
FIGS. 13A and 13B illustrate the next part of the layout creation process shown in FIGS. 12A and 12B.
Figure 13B:
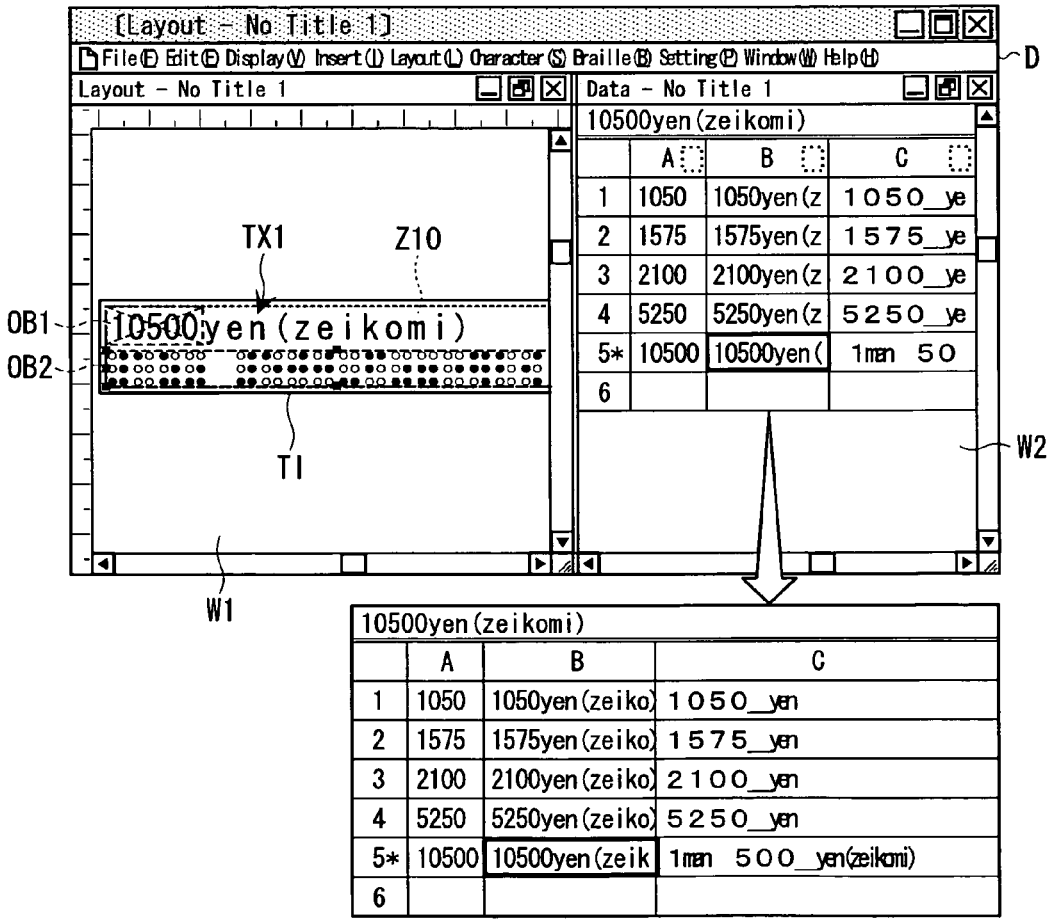

If "Yes" is selected in the message box MB3, the existing braille object OB2 in the tape image TI is deleted, and braille transcription information is input in column C (see FIG. 13A). Although a case where braille transcription information is input to column C and a braille pattern is loaded into the layout window W1 is shown in FIG. 13A, the layout window W1 immediately after conversion into braille transcription information is as shown in FIG. 11B (the braille object OB2 is not displayed). Conversion into braille transcription information is performed in accordance with a braille conversion rule (a rule of leaving a space between words) such that, for example, original text information "1050 yen (zeikomi)" is converted into braille transcription information "1 0 5 0_y en ( ze i ko mi )" or original text information "10500 yen (zeikomi)" is converted into braille transcription information "1 ma n 5 0 0_ye n ( ze i ko mi )", as shown in FIGS. 13A and 13B. The input braille transcription information can be modified in the list window W2 in an appropriate manner.

Loading and disposition of a braille pattern on the screen shown in FIG. 13A is described next. The braille pattern is disposed by clicking and dragging a column property button BT1 for column B (column for original text information) or a column property button BT2 for column C (column for braille transcription information) and by dropping the column property button BT1 or the column property button BT2 onto the tape image TI. At this time, information in a designated cell (corresponding to a row provided with an asterisk mark) in column B is read, and a braille pattern obtained by converting braille transcription information ("1 ma n 5 0 0_ye n ( ze i ko mi )") (in the row provided with the asterisk mark) corresponding to the original text information is loaded to the braille object OB2. By loading, in accordance with information transmission (braille embossing instruction) to the label-making apparatus 1, information read in a row number order of a cell changes, and a braille pattern to be printed also changes in accordance with the changed information. Thus, the user is able to make braille labels of different contents only by giving instructions for ink character printing and/or braille embossing without designating information to be printed and/or embossed subsequently. When braille transcription information is modified, a braille pattern based on the modified braille transcription information is loaded.

In contrast, the position of the braille object OB2 is limited such that the braille object OB2 is disposed in an area within the printable area (effective forming area) Z10 and that an upper side of the braille object OB2 is along an upper side of the printable area (effective forming area) Z10 or a lower side of the braille object OB2 is along a lower side of the printable area (effective forming area) Z10. In other words, since, as described above, the embossing unit 80 that performs braille embossing faces a portion near the lower side of the tape-conveying path 70 and is able to perform embossing of only one row (see FIG. 6), the braille object OB2 can be disposed only in an upper portion or a lower portion within the printable area (effective forming area) Z10 in the tape width direction. Thus, the braille object OB2 is prohibited from being disposed in an area other than such a position. The braille object OB2 is disposed to be attracted to the nearest side (upper side or lower side) of the printable area (effective forming area) Z10 (in the same position in the horizontal direction) from a dropped position (drag end position).

FIG. 13B shows a case where the braille object OB2 and the ink character object OB1 are disposed. Referring to FIG. 13B, the braille object OB2 is disposed in a lower portion (as lower braille characters). Although only an image in a label area (see FIG. 6) is displayed in the layout window W1, an actual label is made such that a left side of the tape image TI shown here is subjected to half cutting, and the insertion mark M1 and the upper and lower marks M2 are printed in a half-cutting area on a leading edge side of the half-cutting position.

A left side of the braille object OB2 overlaps a left side of the printable area (effective forming area) Z10. In this case, the braille object OB2 is disposed with the smallest head margin. In addition, the length of the frame of the braille object OB2 changes in accordance with loaded data (the number of cells of a braille pattern) so that all the loaded data can be displayed. Furthermore, as shown in FIG. 13B, the lengths of the tape image TI and the printable area (effective forming area) Z10 in the tape length direction change depending on the length and position of the braille object OB2. In other words, when the braille pattern is imported, the length of the frame of the braille object OB2 is changed so as to correspond to a length corresponding to the number of cells of the braille pattern, and the lengths of the tape image TI and the printable area (effective forming area) Z10 in the tape length direction also change in accordance with the change in the length of the frame of the braille object OB2. Changing processing of the frame of the braille object OB2 is described later (see FIGS. 15A and 15B).

In FIG. 13B, the ink character object OB1 is also disposed in the tape image TI. In this example, the ink character object OB1 is disposed by loading column A for which the property of a column is designated as text from the editing menu EM2 in FIG. 12A. Although the ink character object OB1 is disposed in an upper portion in FIG. 13A, the ink character object OB1 may be disposed in any position, as described above. Although the length of the braille object OB2 changes depending on loaded data, the length of the ink character object OB1 is fixed in order not to destroy the positional relationship when loading printing is continuously performed. Thus, the length of the printable area (effective forming area) Z10 or the tape image TI does not change depending on data loaded into the ink character object OB1.

In addition, a normal text TX1 "yen (zeikomi)" disposed in the tape image TI is information directly written in the tape image TI. Thus, the position of the normal text TX1 is fixed irrespective of data loaded to the ink character object OB1 or the braille object OB2 (see FIG. 15B). In addition, the normal text TX1 may be disposed in any position as long as the normal text TX1 is disposed within the tape image TI.

When the layout shown in FIG. 13B is created, braille data is generated in accordance with the content and position of the braille object OB2, and ink character data is generated in accordance with the contents and positions of the ink character object OB1 and the normal text TX1. Since the braille object OB2 is disposed in the lower portion, data representing lower braille characters is added to the braille data. Thus, the label-making apparatus 1 prints and embosses ink character printing data and braille embossing data developed from the received ink character data and braille data in the forward direction (see FIG. 9A). As the braille data, instead of transmitting image data (bitmap data) representing a braille pattern, it is desirable that data of one byte in which embossing or non-embossing of each of six embossing points constituting a braille cell 200 is represented by 1 or 0 (for a six-dot braille character, the first and last bits are not used) be transmitted. With this configuration, the amount of transmission data can be reduced.

Changing processing of the frame of a braille object is described next with reference to FIGS. 15A and 15B. FIGS. 15A and 15B show examples in which an ink character object OB1 and a normal text TX1 are disposed in an upper portion of a tape image TI and a braille object OB2 and a normal text TX2 are disposed in a lower portion of the tape image TI. Here, import into the frame of a braille object is performed in a state in which the tape image TI is spread in the tape width direction in advance, as shown in FIG. 15A, in order to dispose the normal text TX2 in an area near a lower right portion of the tape (in consideration of the position of the braille object OB2). In addition, FIG. 15A shows a case where import of a braille transcription pattern (braille transcription information "1 0 5 0_ye n ( ze i ko mi )") of original text information "1050 yen (zeikomi)" is performed. FIG. 15B shows a case where import of a braille transcription pattern (braille transcription information "1 ma n 5 0 0_y en ( ze i ko mi )") of original text information "10500 yen (zeikomi)" is performed.

When the braille transcription pattern of the braille transcription information "1 0 5 0_ye n ( ze i ko mi )" is imported, the braille object OB2 does not overlap the normal text TX2, as shown in FIG. 15A. However, when the braille transcription pattern of the braille transcription information "1 ma n.5 0 0_ye n ( ze i ko mi )" is imported, since the number of braille cells increases by four, the size of the frame of the braille object OB2 increases, and the trailing edge side of the braille object OB2 overlaps the normal text TX2. Accordingly, since the length of the braille object OB2 changes depending on the braille pattern (loaded data), for the layout shown in FIG. 15B, the braille object OB2 may overlaps the normal text TX2. However, since overlapping information is braille characters B and ink characters P, a product has no trouble. On the contrary, an advantage in effective use of the tape T is achieved.

Figure 17A:
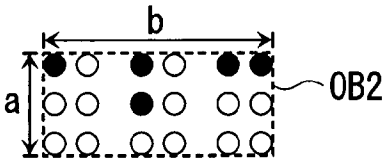
FIGS. 17A and 17B illustrate areas inside and outside a tape image.
Figure 17B:
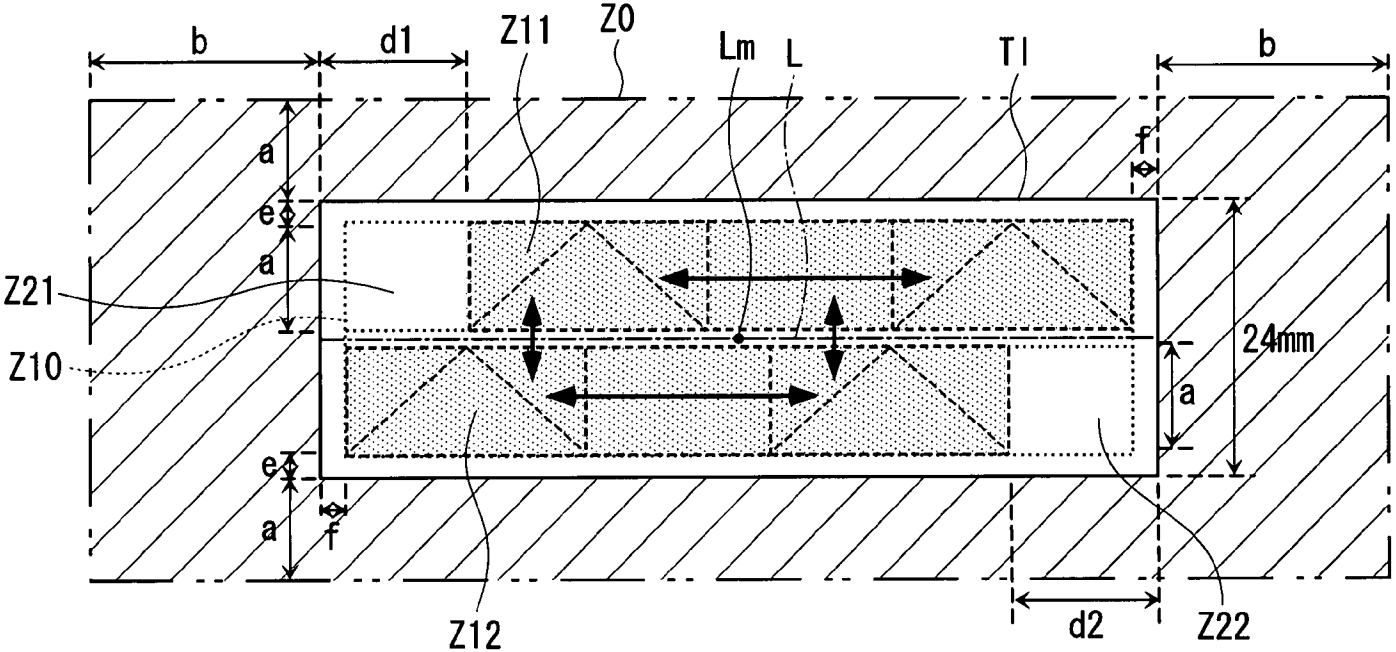

As shown in FIG. 15B, the trailing edge of the tape image TI is displayed such that the tape image TI is to be cut at a position where a predetermined margin (a tail margin d2 when a lower braille character is disposed, see FIGS. 17A and 17B) is provided on the trailing edge side (right side) of the braille object OB2. The tape image TI is cut with an allowance for displacement of tape feeding when braille embossing is performed, and the margin is automatically set. Thus, the length of the tape cannot be set shorter by user editing. Since a margin larger than a predetermined distance from the trailing edge side (right side) of the braille object OB2 is provided in the case shown in FIG. 15A, the margin is equal to the length set in advance by the user.

For the leading edge side of the tape T, in terms of tape feeding, a predetermined length L2 from the leading edge of the tape to a position where embossing starts is required (see FIG. 6). However, since a half-cutting area is formed in a braille label LB2, a special margin is not required. Thus, the leading edge of the braille object OB2 can be disposed at the leading edge of the printable area (effective forming area) Z10.

For an ink character object OB1, ink character information "1050" is imported in the case shown in FIG. 15A, and ink character information "10500" is imported in the case shown in FIG. 15B. When the size of the frame of the ink character object OB1 is set corresponding to the ink character information "1050", the size of the ink character information "10500" is reduced so as to correspond to the size of the frame of the ink character object OB1. Such a reduction is performed since if the ink character object OB1 overlaps the normal text TX1 "yen (zeikomi)", the visibility of ink characters in an overlapping portion is reduced.

As described above, according to this embodiment, information read from the list window W2 is converted into a braille pattern, and the braille pattern is loaded into an object frame disposed in a tape image TI. Thus, if a plurality of pieces of information is input to the list window W2, many braille products can be made quickly and easily.

In addition, if original text information is simply input to the list window W2, the input original text information is converted into braille transcription information (a braille document) based on a braille conversion rule. Then, the braille transcription information is converted into a braille pattern, and the braille pattern is loaded. Thus, even a user who does not have knowledge of braille transcription can easily make a braille pattern. In addition, if conversion from original text information into braille transcription information is not correctly performed, correction can be performed. Thus, embossing of an incorrect braille pattern can be avoided.

In addition, the sizes of the tape image TI and the printable area (effective forming area) Z10 change depending on the length of a braille pattern and the position of a braille object OB2. Thus, the user does not need to set ranges for the tape image TI and the printable area (effective forming area) Z10. Therefore, the braille object OB2 can be easily disposed in the tape image TI.

In addition, loading of a braille pattern can be performed by dragging and dropping original text information (the column property button BT1) in the list window W2 into the frame of the braille object OB2. Thus, the user is able to perform loading and disposition at the same time.

The length of an ink character object OB1 is fixed even if data is different depending on the target cell in a target column (column A) in the list window W2 since the position of the ink character object OB1 must be fixed in order not to overlap objects. In contrast, the length of a braille object OB2 may be variable since only one braille object exists and braille characters B are identifiable even if the braille characters B overlap information for printing ink characters P (an ink character object OB1 or a normal text TX). Thus, the braille object OB2 can be disposed easily. Moreover, there is an advantage in which the braille object OB2 can be efficiently disposed within the minimum label length without concern about overlapping of the braille object OB2 and ink characters P.

Although the configuration (the embossing unit 80, see FIG. 6) in which braille embossing for only one row can be performed has been described above as an example, when a configuration in which braille embossing for a plurality of rows can be performed is adopted, the sizes of the tape image TI and the printable area (effective forming area) Z10 vary depending on the length in the row direction corresponding to the number of rows of a braille string as well as the length in the column direction corresponding to the number of braille characters.

In the example described above, a case where original text information is input to the list window W2 is described. However, a list file may be stored in a recording medium M (see FIG. 1), such as a memory card, and original text information may be read from the list file and may be converted into the braille transcription information and a braille pattern. Alternatively, braille transcription information and a braille pattern may be read from a list file in which the braille transcription information and the braille pattern are listed. However, when a braille pattern is read from a list file, it is desirable that the braille pattern be capable of being listed (displayed) in the list window W2.

In addition, in the example described above, braille transcription information converted from original text information is displayed in the list window W2 and the braille transcription information is converted into a braille pattern when loading is performed. However, only original text information may be displayed in the list window W2. In this case, the original text information is directly converted into a braille pattern, and loading is performed. With this configuration, efforts in braille transcription into braille transcription information can be eliminated.

In addition, in the example described above, a braille pattern is loaded into a braille object OB2 in accordance with original text information or braille transcription information sequentially read from the list window W2. However, instead of changing information in accordance with each instruction of ink character printing and/or braille embossing (for each information transmission), the user may designate a cell as an import target for each braille embossing and a braille pattern may be imported into the braille object OB2 in accordance with the instruction. In addition, instead of reading information from the list window W2 in accordance with each instruction of printing and/or embossing as a trigger, information may be sequentially read in accordance with a predetermined user operation as a trigger.

A second embodiment of the invention is described next with reference to FIGS. 16A, 16B, 17A, 17B, 18A, 18B, 19A, 19B, 20A, and 20B. In the embodiment described above, the position of a braille object OB2 is limited to an area within the printable area (effective forming area) Z10 inside a tape image TI. In contrast, in this embodiment, the limitation in disposition is relaxed, and an area in which free disposition can be performed is provided. Thus, editing in the tape image TI can be easily performed.

Figure 16A:
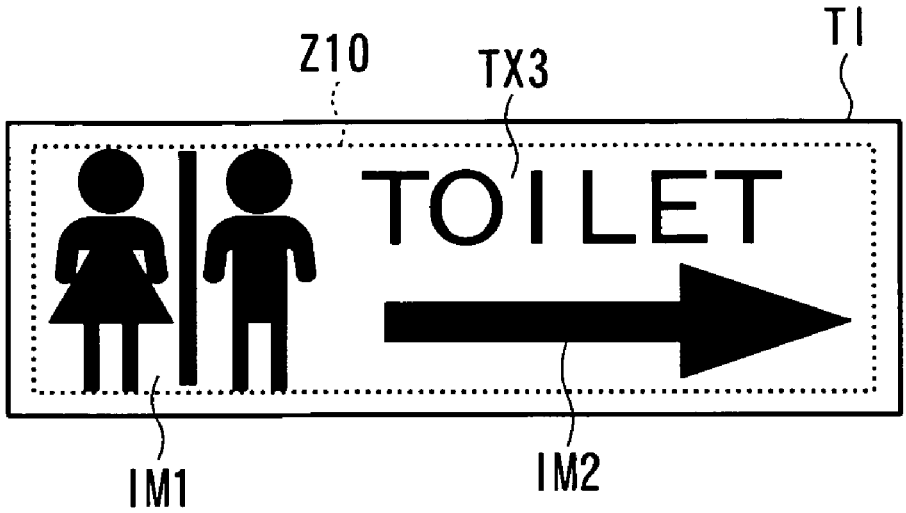
FIGS. 16A and 16B illustrate an object of a second embodiment.
Figure 16B:
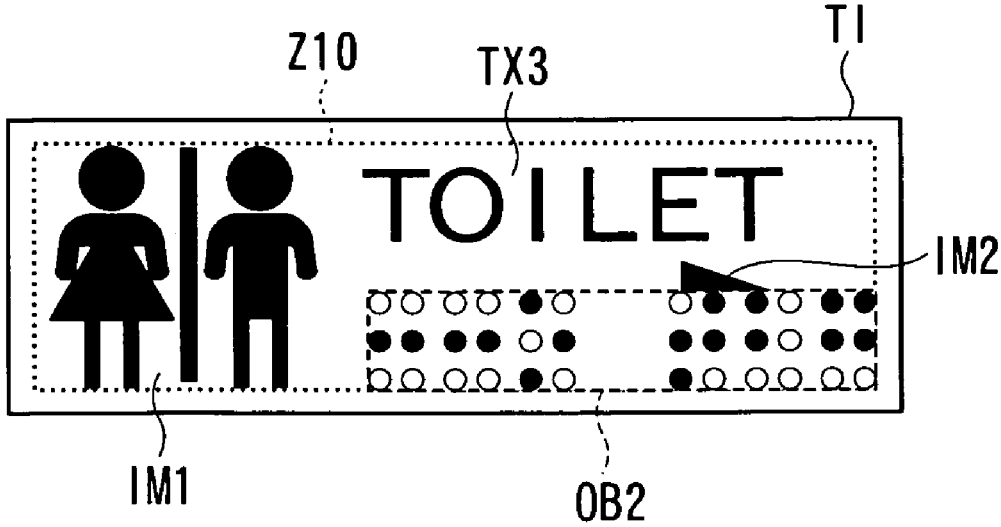

For example, a braille object OB2 is disposed, as shown in FIG. 16B, in a tape image TI shown in FIG. 16A including images IM1 and IM2 and a,normal text TX3, and modification of the image IM2 is required. In this case, if the position (movement) of the braille object OB2 is limited within the printable area (effective forming area) Z10, (1) the braille object OB2 must be moved upward or (2) after the braille object OB2 is moved to the back of the image IM2, the image IM2 must be modified. However, for case (1), since the normal text TX3 disposed in an upper portion is hidden, the entire arrangement cannot be easily seen. In addition, for case (2), since a braille pattern cannot be seen, the validity of a product cannot be determined. In addition, when the width of the tape is narrow (for example, when the tape T3 with a tape width of 12 mm is used, see FIG. 6), since the braille object OB2 cannot be moved upward as in case (1), editing is much difficult.

Thus, in consideration of the above-mentioned points, in this embodiment, free disposition of a braille object OB2 can be performed in an area outside the tape image TI. In addition, since the braille object OB2 cannot be disposed in a portion even within the printable area (effective forming area) Z10 depending on the configuration of the embossing unit 80 and the tape feed unit 60 of the braille-embossing section 150, disposition of the braille object OB2 in such an area (hereinafter, referred to as a "not-embossable area") is prohibited and the braille object OB2 is disposed to be attracted to an appropriate position. Points different from the first embodiment will now be mainly described.

FIGS. 17A and 17B illustrate limitation on disposition of a braille object OB2 inside and outside a tape image TI. In this example, the braille object OB2 (a braille pattern based on original text information "a i u" and braille transcription information "a i u") shown in FIG. 17A is disposed in the tape image TI of the tape T1 with a tape width of 24 mm shown in FIG. 17B. In addition, as shown in FIG. 17A, the size of the braille object OB2 is defined in accordance with a length from the upper end of the uppermost embossing point (for example, the embossing point 201*a*) to the lower end of the lowermost embossing point (for example, the embossing point 201*c*) (that is, a length a in the tape width direction) and a length from the left end of the leftmost embossing point (for example, the embossing point 201*a*) of the first braille cell 200 to the right end of the rightmost embossing point (for example, the embossing point 201*d*) of the last braille cell 200 (that is, a length b in the tape length direction) (see FIG. 4A). Thus, the length a in the tape width direction of the braille object OB2 is a fixed value irrespective of a braille pattern (irrespective of loaded data or the number of transcribed characters), and the length b in the tape length direction is a variable value that varies depending on the braille pattern.

The size of the braille object OB2 may be defined in any way. For example, the size of the braille object OB2 may be defined in unit of cell, such as based on an area from a left side of the first braille cell to a right side of the last braille cell. Alternatively, for example, the length b in the tape length direction may be defined based on the distance between columns in which braille embossing points exist, such as an area from the first braille column in which an actual embossing point exists (a black point in FIG. 17A) to the last braille column in which an actual embossing point exists.

When the braille object OB2 with the above-mentioned size is disposed in a tape image TI, the braille object OB2 is prohibited from being disposed in a restricted area Z0 represented by oblique lines in FIG. 17B. However, in an area outside the restricted area Z0, free disposition of the braille object OB2 (disposition in any position) can be performed. The outer shape of the restricted area Z0 is a rectangular having sides away from the tape image TI by a in the tape width direction (the vertical direction in FIG. 17B) and sides away from the tape image TI by b in the tape length direction (the horizontal direction in FIG. 17B). The restricted area Z0 is an area of the rectangle other than the area of the tape image TI. In other words, when the braille object OB2 is disposed from outside the restricted area Z0, the braille object OB2 is attracted to an embossable area Z11 or Z12 represented by hatching in FIG. 17B.

The embossable areas Z11 and Z12 are included within the printable area (effective forming area) Z10, which is inside the tape image TI. When the printable area (effective forming area) Z10 has a rectangular shape having sides away from the tape image TI by e in the tape width direction and sides away from the tape image TI by f from the tape image TI in the tape length direction, the embossable area Z11 is an area obtained by excluding a not-embossable area Z21 from an area formed by the track of a path that is away from (lower than) the upper side of the printable area (effective forming area) Z10 by a in the tape width direction. In addition, the embossable area Z12 is an area obtained by excluding a not-embossable area Z22 from an area formed by the track of a path that is away from (higher than) the lower side of the printable area (effective forming area) Z10 by a in the tape width direction. In other words, the size of the embossable area Z11 is equal to the size of the embossable area Z12. An area obtained by rotating one of the embossable area Z11 or the embossable area Z12 180 degrees based on a middle point Lm of a center line (a boundary line for adsorption switching) L in the tape width direction of the printable area (effective forming area) Z10 and the tape image TI overlaps the other one of the embossable area Z11 and the embossable area Z12. The boundary line L for adsorption switching indicates a position of a boundary for attracting the braille object OB2 to the embossable area Z11 or the embossable area Z12. When the center of a portion where the braille object OB2 is dropped is located above the boundary line L, the braille object OB2 is attracted to the embossable area Z11. When the center of a portion where the braille object OB2 is dropped is located below the boundary line L, the braille object OB2 is attracted to the embossable area Z12.

The boundary line L for adsorption switching is provided for a tape with a width of 24 mm and a tape with a width of 18 mm. For a tape with a width of 18 mm, part of the embossable area Z11 overlaps part of the embossable area Z12 by the amount of reduction in the width direction compared with a tape with a width of 24 mm. The boundary line L for adsorption switching is not provided for a tape with a width of 12 mm. The tape with a width of 12 mm has only the embossalbe area Z11. The boundary line L for adsorption switching is provided since the braille object OB2 can be disposed only in an upper portion or a lower portion of the printable area (effective forming area) Z10 in the tape width direction in terms of the position of the embossing unit 80.

In addition, the not-embossable areas Z21 and Z22 are provided in consideration of displacement in feeding when braille embossing is performed, and the size of the not-embossable area Z21 is equal to the size of the not-embossable area Z22, as described above. In other words, the not-embossable area Z21 is a part of an upper left portion of the printable area (effective forming area) Z10 and has a rectangular shape formed by the length a in the tape width direction and a length (d1-f) in the tape length direction. The not-embossable area Z22 is a part of a lower right portion of the printable area (effective forming area) Z10 and has a rectangular shape formed by the length a in the tape width direction and a length (d2-f) in the tape length direction. The length d1 represents a tail margin for embossing when upper braille characters are disposed, and the length d2 represents a tail margin for embossing when lower braille characters are disposed. The length d1 is equal to the tail margin for embossing when upper braille characters are disposed since the tape T is inserted from right in FIG. 17B when the upper braille characters are disposed (see FIG. 9A).

Figure 18A:
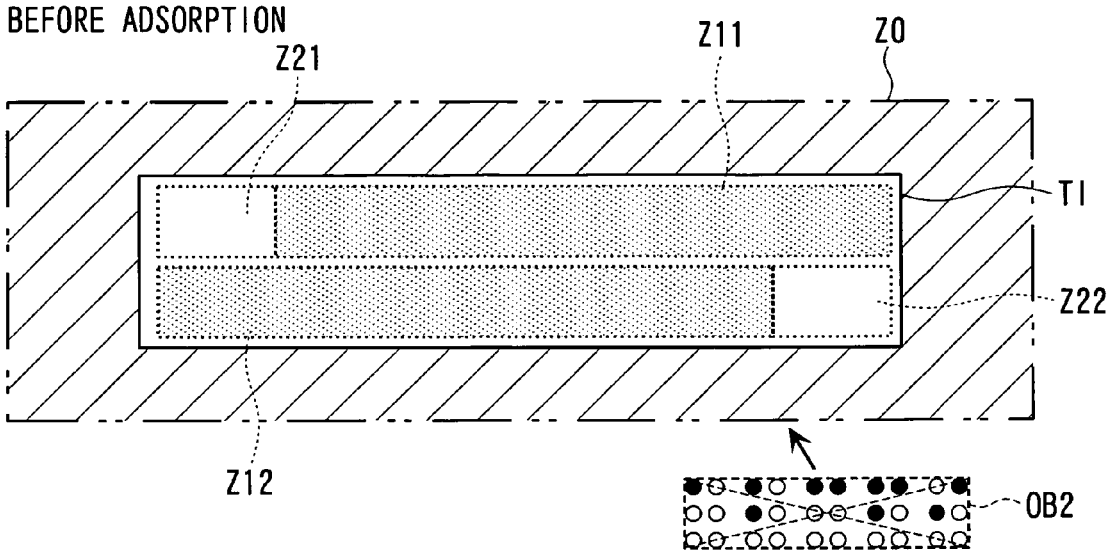
FIGS. 18A and 18B show an example of adsorption of a braille object.
Figure 18B:
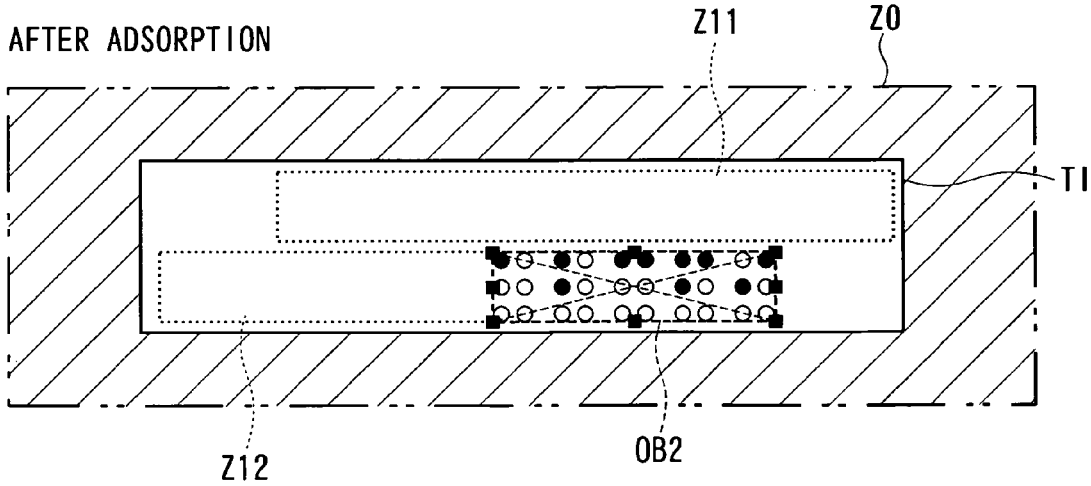

Adsorption of the braille object OB2 is described next with reference to FIGS. 18A, 18B, 19A, 19B, 20A, and 20B. FIG. 18A and 18B shows adsorption when the braille object OB2 is dragged from a lower right portion outside the restricted area Z0. When the braille object OB2 is dropped to the restricted area Z0, the not-embossable area Z21, or the not-embossable area Z22 from a position shown in FIG. 18A (when a movement end position is within the restricted area Z0, the not-embossing area Z21, or the not-embossing area Z22), the braille object OB2 is disposed to be attracted to a right portion of the embossable area Z12 (such that the right side of the braille object OB2 overlaps the right side of the embossable area Z12), as shown in FIG. 18B. In other words, the braille object OB2 is disposed in a position within the embossable area Z11 or Z12 that is nearer the dropped position. That is, the braille object OB2 is adsorbed in accordance with an outline of the embossable area Z11 or Z12 that is nearer a position in which disposition of the braille object OB2 is prohibited as a guide.

The area within the restricted area Z0, the not-embossing area Z21, the not-embossing area Z22 is an area in which part of the braille object OB2 overlaps the restricted area Z0, the not-embossable area Z21, or the not-embossable area Z22. The area other than the restricted area Z0 is an area in which part of the braille object OB2 does not overlap the tape image TI or the restricted area Z0. In other words, when the braille object OB2 is disposed such that part of the braille object OB2 overlaps the restricted area Z0, the not-embossable area Z21, or the not-embossable area Z22, such disposition is prohibited. When the entire braille object OB2 is located outside the restricted area Z0, free disposition can be performed. As described above, since disposition of the braille object OB2 in the embossable area Z11 or Z12 in which braille embossing is actually performed is permitted, the braille object OB2 can be easily disposed in an appropriate position in the tape image TI.

Figure 19A:
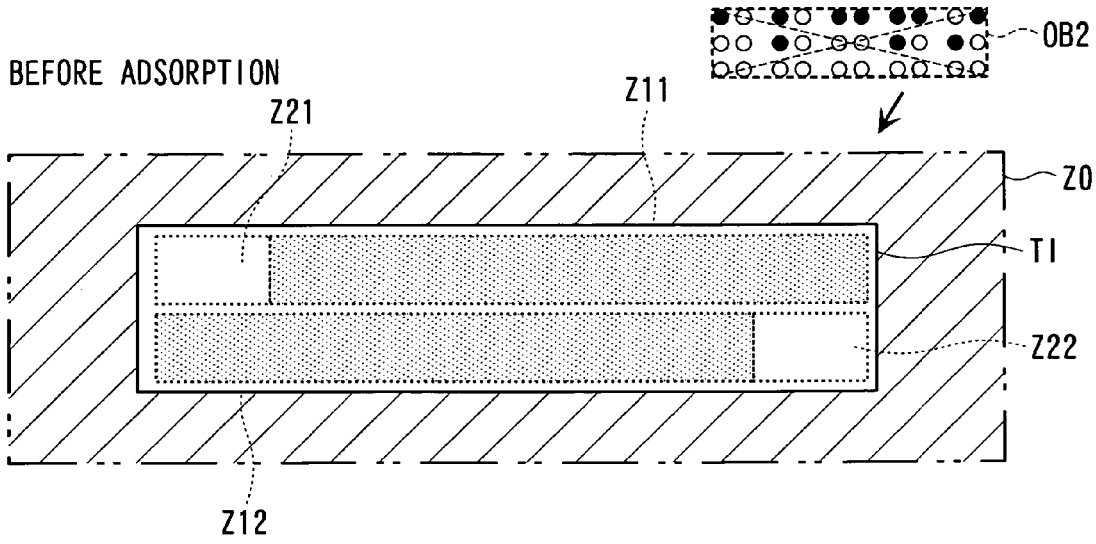
FIGS. 19A and 19B show another example of adsorption of a braille object.
Figure 19B:
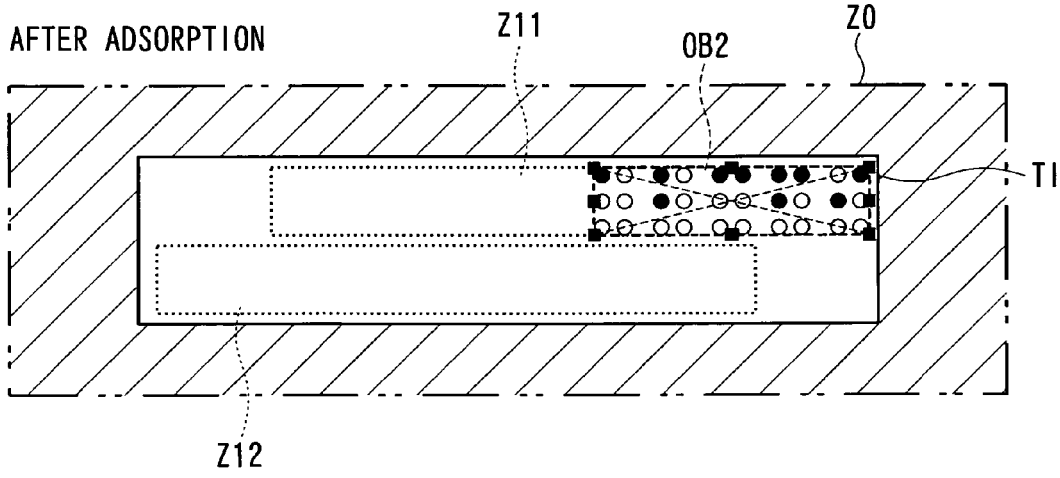

In addition, when the braille object OB2 is dragged from an upper right portion outside the restricted area Z0, as shown in FIG. 19A, the braille object OB2 is adsorbed to a right portion of the embossable area Z11 (such that the right side of the braille object OB2 overlaps the right side of the embossable area Z11), as shown in FIG. 19B.

Figure 20A:
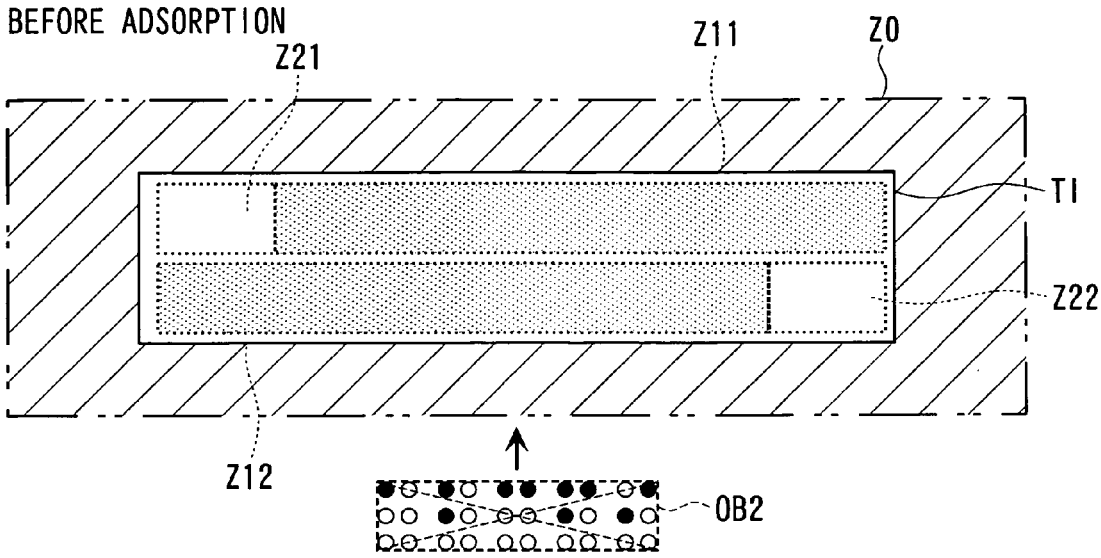
FIGS. 20A and 20B show another example of adsorption of a braille object.
Figure 20B:
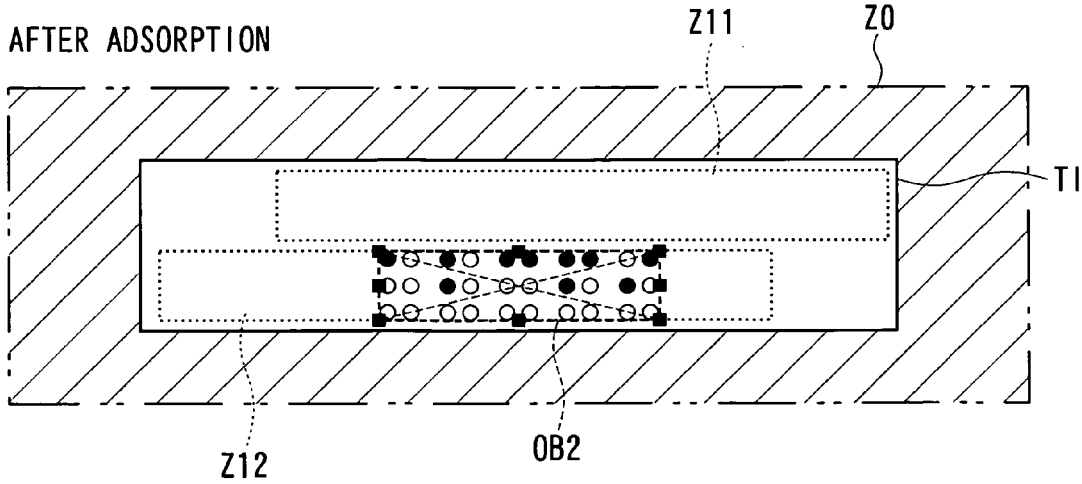

In addition, when the braille object OB2 is dragged from a lower center portion outside the restricted area Z0, as shown in FIG. 20A, the braille object OB2 is adsorbed along the outline of the nearest embossable area Z12 as a guide in the same position in the tape length direction (horizontal direction) as a dropped position (such that the lower side of the braille object OB2 overlaps the lower side of the embossable area Z12), as shown in FIG. 20B.

As described above, according to the second embodiment, since disposition of the braille object OB2 in the restricted area Z0, which is outside the tape image TI, the not-embossable area Z21, or the not-embossable area Z22 is prohibited, the braille object OB2 is not disposed in a position outside the tape image TI or in a position in which embossing cannot be performed. In addition, when disposition is prohibited, the braille object OB2 is adsorbed inside the outline of the embossable area Z11 or Z12, which is within the tape image TI, as a guide. Thus, the braille object OB2 can be disposed in an appropriate position in the tape image TI without performing a special operation.

In addition, in an area outside the restricted area Z0, free disposition of the braille object OB2 can be performed (the braille object OB2 is disposed in a movement end position of the braille object OB2 without any restriction). Thus, when other information forming elements (images, normal texts, and the like) and an ink character object OB1 are edited in the tape image TI, such editing is not interrupted by evacuating the braille object OB2 outside the restricted area Z0.

In addition, the braille object OB2 is adsorbed to a position within the embossable area Z11 or Z12 that is nearer the movement end position of the braille object OB2. Thus, the braille object OB2 can be disposed in a position that provides the user with the least feeling of wrongness.

Although free disposition of the braille object OB2 can be performed in an area outside the restricted area Z0, it is desirable that free disposition of the ink character object OB1 be also performed in an area outside the restricted area Z0. With this configuration, editing in the tape image TI can be performed more easily.

In addition, each section (each feature) of the PC 501 or the label-making apparatus 1 may be provided as a program. In addition, the program may be provided by storing the program in a recording medium (not shown). The recording medium may be a compact-disk read-only memory (CD-ROM), a flash ROM, a memory card (Compact Flash™, smart media, a memory stick, or the like), a compact disk, an optical magnetic disk, a digital versatile disk, a flexible disk, or the like.

The invention is not necessarily limited to the foregoing embodiments. Various changes can be made to the invention without departing from the scope of the invention with respect to the system configuration of the label-making system SYS, the apparatus structure of the label-making apparatus 1, a process performed by the PC 501 or the label-making apparatus 1, and the like. In addition, the invention is also applicable to a system that disposes an object in an image of an information forming sheet on which information is to be formed and creates a layout for performing information formation even in a case where processing other than braille embossing is performed.

What is claimed is:

1. A braille layout creation method comprising the steps of:

sequentially reading information for braille embossing from a list file in which a plurality of pieces of information for braille embossing is listed;

converting the read information into a braille pattern; and importing, for each reading of the information, the braille pattern into an object frame disposed in an image of a sheet on which a character is embossed.

2. The braille layout creation method according to claim 1, further comprising the step of performing braille embossing in accordance with the pattern imported into the object frame, wherein in the step of sequentially reading the information, the information is sequentially read from the list file for each braille embossing performed by the step of performing the braille embossing.

3. The braille layout creation method according to claim 1, wherein:

the information is original text information input as text data; and in the step of converting the read information, the original text information read from the list file is converted into braille transcription information in accordance with a braille notation, and the transcription information is converted into the braille pattern.

4. The braille layout creation method according to claim 3, further comprising the step of editing the converted braille transcription information, wherein in the step of converting the read information, the edited braille transcription information is converted into the braille pattern.

5. The braille layout creation method according to claim 1, further comprising the step of disposing the object frame in a position.

6. A braille layout creation system comprising:

a layout display device that displays an image of a braille sheet on which a braille character is embossed and an object frame disposed in the image of the braille sheet;

a list display device that displays a list in which a plurality of pieces of information for braille embossing is listed;

an information reading device that sequentially reads the information from the list;

a conversion device that converts the read information into a braille pattern; and an import device that imports, for each reading of the information performed by the information reading device, the converted braille pattern into the object frame.

7. The braille layout creation system according to claim 6, further comprising a disposing device that disposes the object frame in the image of the braille sheet by dragging and dropping the information within the list.

* * * * *